US009285707B2

(12) United States Patent
Matsushita et al.

(10) Patent No.: US 9,285,707 B2
(45) Date of Patent: Mar. 15, 2016

(54) DEVELOPER ACCOMMODATING UNIT WITH A URGING MEMBER FOR URGING A FLEXIBLE MEMBER

(71) Applicant: CANON KABUSHIKI KAISHA, Tokyo (JP)

(72) Inventors: Masaaki Matsushita, Yokohama (JP); Koji Yamaguchi, Numazu (JP); Junichi Matsumura, Numazu (JP); Masatomi Yoshida, Kawazaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/687,440

(22) Filed: Nov. 28, 2012

(65) Prior Publication Data

US 2013/0164039 A1 Jun. 27, 2013

(30) Foreign Application Priority Data

Nov. 29, 2011 (JP) ..... 2011-260270

(51) Int. Cl.
*G03G 15/08* (2006.01)
*G03G 21/18* (2006.01)

(52) U.S. Cl.
CPC ..... *G03G 15/0874* (2013.01); *G03G 15/0881* (2013.01); *G03G 15/0889* (2013.01); *G03G 21/18* (2013.01); *G03G 2215/0682* (2013.01)

(58) Field of Classification Search
None
See application file for complete search history.

(56) References Cited

U.S. PATENT DOCUMENTS

| | | | | | |
|---|---|---|---|---|---|
| 4,984,023 | A | * | 1/1991 | Yoshida | 399/106 |
| 5,075,727 | A | * | 12/1991 | Nakatomi | 399/103 |
| 5,752,613 | A | * | 5/1998 | Sasaki et al. | 220/86.1 |
| 5,761,584 | A | * | 6/1998 | Tsuda et al. | 399/258 |
| 6,122,458 | A | * | 9/2000 | Kita et al. | 399/27 |
| 6,128,462 | A | | 10/2000 | Kato et al. | |
| 6,169,869 | B1 | | 1/2001 | Inami et al. | |
| 6,175,703 | B1 | | 1/2001 | Nakazono et al. | |
| 6,337,964 | B2 | | 1/2002 | Inami et al. | |
| 6,501,913 | B2 | | 12/2002 | Hattori et al. | |
| 6,539,190 | B2 | | 3/2003 | Oba et al. | |
| 6,681,088 | B2 | | 1/2004 | Kanno et al. | |
| 6,721,525 | B2 | * | 4/2004 | Wang et al. | 399/258 |

(Continued)

FOREIGN PATENT DOCUMENTS

| | | | | |
|---|---|---|---|---|
| JP | 4-66980 | | 3/1992 | |
| JP | 04066980 | A * | 3/1992 | G03G 15/08 |

(Continued)

OTHER PUBLICATIONS

English translation of JPA-2011-232541.*

(Continued)

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

A developer accommodating unit includes: a flexible container, provided with an opening for permitting discharge of a developer, for accommodating the developer; a frame for accommodating the flexible container and for accommodating the developer discharged from the flexible container; and an urging member, provided inside the frame, for urging the flexible container to deform the flexible container. The flexible container has a plurality of sides including an opening-containing side and another side having stiffness lower than that of the opening-containing side.

22 Claims, 32 Drawing Sheets

(56) References Cited

U.S. PATENT DOCUMENTS

| | | | | |
|---|---|---|---|---|
| 6,782,219 | B2 | 8/2004 | Yoshino et al. | |
| 6,834,173 | B2 | 12/2004 | Yamaguchi et al. | |
| 6,898,401 | B2 | 5/2005 | Okano et al. | |
| 6,915,092 | B2 | 7/2005 | Yamaguchi et al. | |
| 6,947,687 | B2 | 9/2005 | Yamaguchi et al. | |
| 6,961,528 | B2 | 11/2005 | Yamaguchi et al. | |
| 6,963,706 | B2 | 11/2005 | Morioka et al. | |
| 6,983,115 | B2 | 1/2006 | Isobe et al. | |
| 7,068,965 | B2 | 6/2006 | Yoshino et al. | |
| 7,116,925 | B2 | 10/2006 | Yamaguchi | |
| 7,136,604 | B2 | 11/2006 | Chadani et al. | |
| 7,184,687 | B2 | 2/2007 | Yamaguchi et al. | |
| 7,194,225 | B2 | 3/2007 | Yamaguchi | |
| 7,319,834 | B2 | 1/2008 | Yamaguchi | |
| 7,398,040 | B2 | 7/2008 | Yoshida | |
| 7,477,865 | B2 | 1/2009 | Yamaguchi et al. | |
| 7,519,310 | B2 | 4/2009 | Yamaguchi et al. | |
| 7,680,442 | B2 * | 3/2010 | Muramoto et al. | 399/254 |
| 7,792,460 | B2 | 9/2010 | Yamaguchi et al. | |
| 8,121,519 | B2 | 2/2012 | Yamaguchi et al. | |
| 2002/0021919 | A1 * | 2/2002 | Tamaki et al. | 399/258 |
| 2003/0017066 | A1 * | 1/2003 | Danby et al. | 417/474 |
| 2003/0161644 | A1 * | 8/2003 | Yokoi et al. | 399/27 |
| 2003/0235436 | A1 * | 12/2003 | Kasahara et al. | 399/258 |
| 2004/0179866 | A1 * | 9/2004 | Muramatsu et al. | 399/258 |
| 2004/0247343 | A1 | 12/2004 | Matsumoto et al. | |
| 2005/0089347 | A1 | 4/2005 | Muramatsu et al. | |
| 2007/0122207 | A1 * | 5/2007 | Matsumoto et al. | 399/258 |
| 2007/0280742 | A1 * | 12/2007 | Matsumoto et al. | 399/258 |
| 2008/0102393 | A1 * | 5/2008 | Hasegawa | 430/109.3 |
| 2008/0219683 | A1 * | 9/2008 | Muramatsu | 399/27 |
| 2009/0074471 | A1 * | 3/2009 | Takami | 399/260 |
| 2010/0199610 | A1 * | 8/2010 | Komatsu et al. | 53/461 |
| 2011/0064478 | A1 * | 3/2011 | Yamaguchi et al. | 399/262 |
| 2011/0142487 | A1 | 6/2011 | Anan et al. | |
| 2011/0170906 | A1 | 7/2011 | Matsushita et al. | |
| 2012/0027457 | A1 | 2/2012 | Yamaguchi et al. | |
| 2012/0177406 | A1 * | 7/2012 | Suzuki et al. | 399/120 |
| 2012/0219318 | A1 * | 8/2012 | Yoshida et al. | 399/110 |
| 2013/0039678 | A1 | 2/2013 | Yoshida et al. | |
| 2015/0205226 | A1 * | 7/2015 | Komatsu et al. | 399/258 |

FOREIGN PATENT DOCUMENTS

| | | | | |
|---|---|---|---|---|
| JP | 8-171281 | | 7/1996 | |
| JP | 2000-147879 | | 5/2000 | |
| JP | 2002-68300 | | 3/2002 | |
| JP | 2011-232541 | A * | 11/2011 | G03G 15/08 |
| WO | 2011/136129 | | 11/2011 | |

OTHER PUBLICATIONS

International Search Report and Written Opinion of the International Searching Authority in International Patent Application No. PCT/JP2012/081435, issued Apr. 5, 2013.

* cited by examiner (a)

(b)

(a)

(b)

(a)

(b)

(a)

(b)

(a)

(b)

(a)

(b)

(c)

(d)

(a)

(b)

(c)

(a)

(b)

DEVELOPER ACCOMMODATING UNIT WITH A URGING MEMBER FOR URGING A FLEXIBLE MEMBER

FIELD OF THE INVENTION AND RELATED ART

The present invention relates to a developer accommodating unit for accommodating a developer, a process cartridge including the developer accommodating unit, and an electrophotographic image forming apparatus including these members.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the process cartridge refers to a cartridge, prepared by integrally assembling at least a developing means and a developing device, detachably mountable to a main assembly of the image forming apparatus and refers to a cartridge, prepared by integrally assembling the developing device and a photosensitive member unit including at least a photosensitive member, detachably mountable to the main assembly of the image forming apparatus.

Further, the developer accommodating unit is accommodated in the image forming apparatus or the process cartridge. The developer accommodating unit at least include a flexible container for accommodating the developer.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

In such a process cartridge, as shown in FIG. 20, an opening provided to a developer accommodating frame 34 for accommodating a developer (toner, carrier, etc.) is sealed with a sealing member. Further, a type in which a bonding portion 33 of a toner seal 32 as a sealing member is peeled off at the time of use to unseal the opening, thus enabling feeding (supply) of the developer has been widely employed (Japanese Laid-Open Patent Application (JP-A) Hei 04-66980, FIG. 13).

Further, in order to solve a problem such that the developer is scattered in the process cartridge in a developer filling step during manufacturing of the process cartridge, a constitution in which a deformable inside container is used has been devised (JP-A Hei 04-66980, FIG. 1).

In the conventional technique, for the purpose of improving operativity of the developer feeding and of reducing a cost of a developer feeding device by preventing the scattering of the developer in the process cartridge, a method of accommodating the developer in the deformable inside container (flexible container) is described. However, in this method, operation and mechanism relating to discharge of the developer after the unsealing are not described.

SUMMARY OF THE INVENTION

The present invention has been accomplished in view of the above-described circumstances. A principal object of the present invention is to provide a developer accommodating unit capable of satisfactorily effecting discharge of a developer from a flexible container.

According to an aspect of the present invention, there is provided a developer accommodating unit comprising: a flexible container, provided with an opening for permitting discharge of a developer, for accommodating the developer; a frame for accommodating the flexible container and for accommodating the developer discharged from the flexible container; and an urging member, provided inside the frame, for urging the flexible container to deform the flexible container, wherein the flexible container has a plurality of sides including an opening-containing side and another side having stiffness lower than that of the opening-containing side.

These and other objects, features and advantages of the present invention will become more apparent upon a consideration of the following description of the preferred embodiments of the present invention taken in conjunction with the accompanying drawings.

Figure 5:
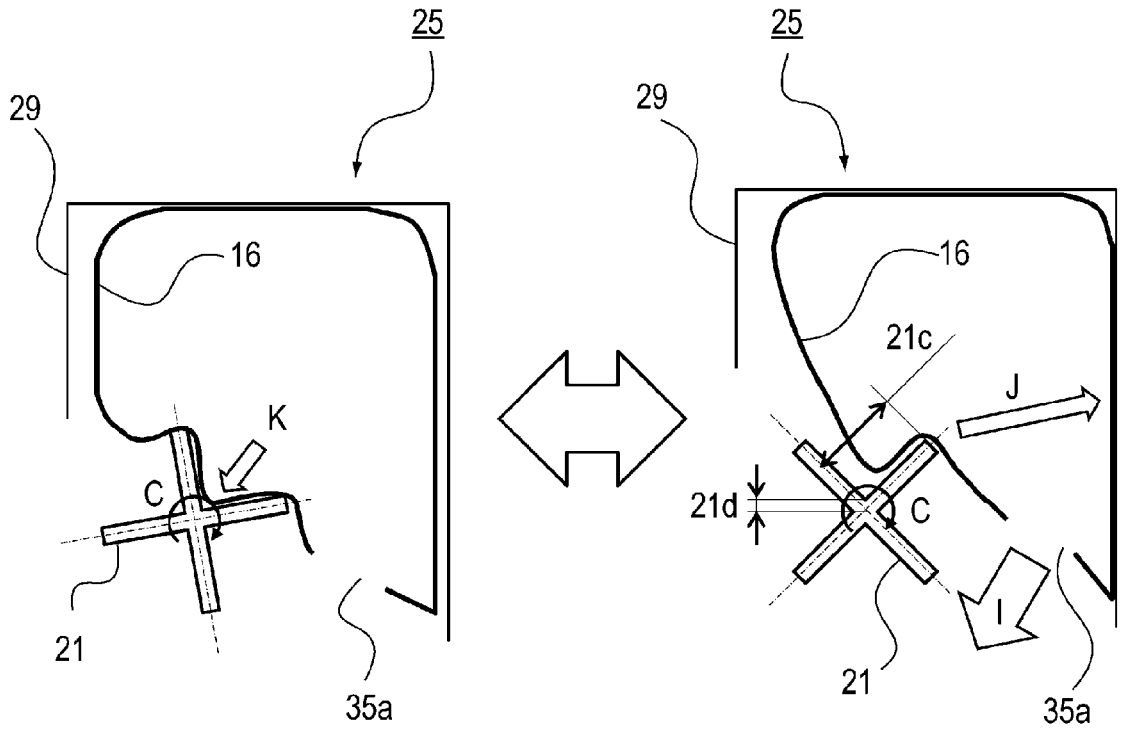
Figure 5:
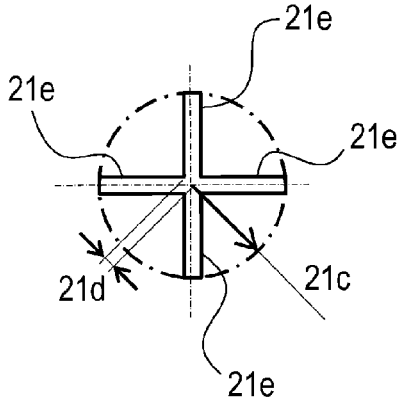

Parts (*a*) and (*b*) of FIG. 5 are sectional views showing a structure (another structure) of an urging member.

Figure 6:
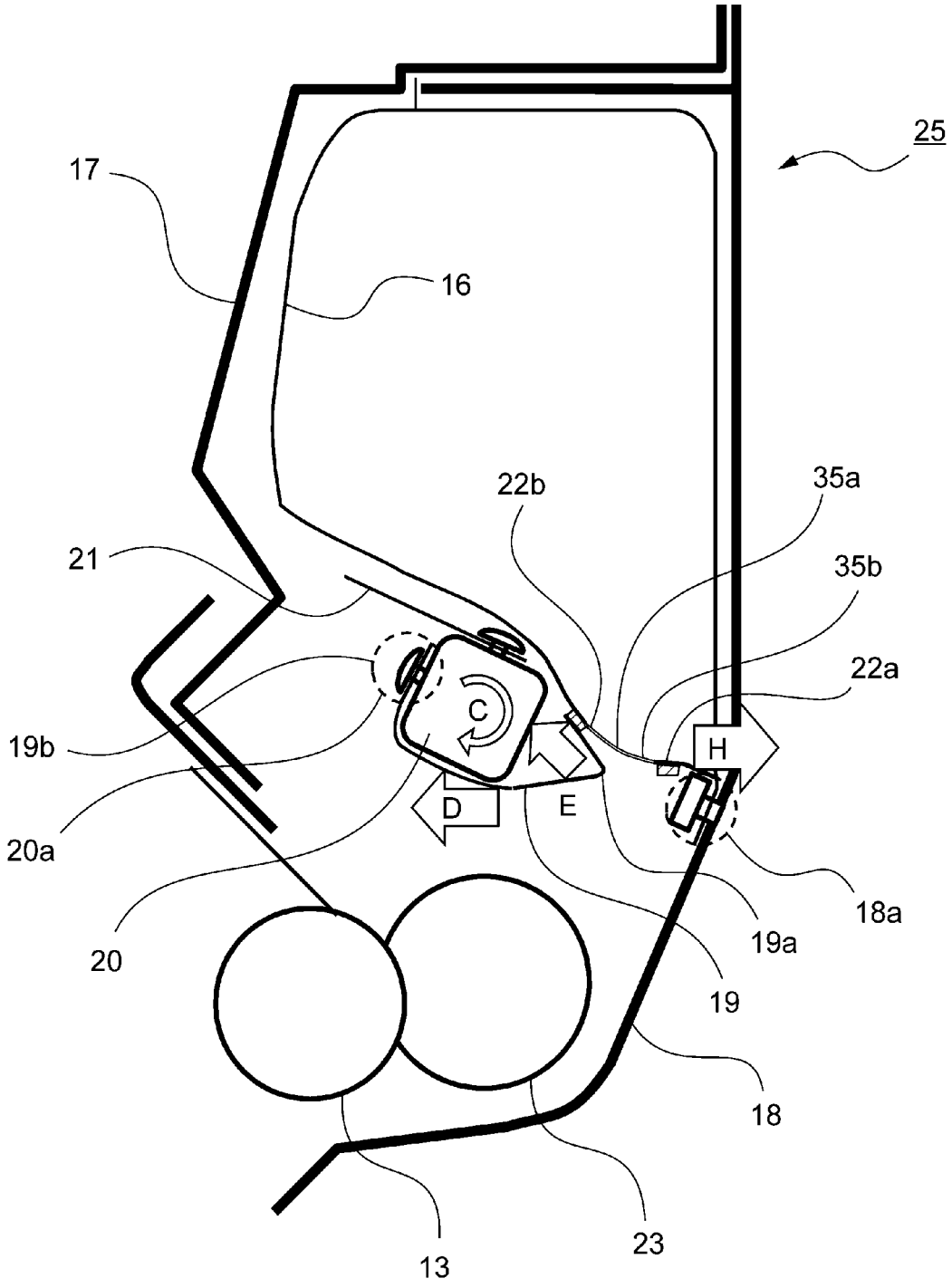

FIG. 6 is a sectional view for illustrating an operation in the inside of the frame.

Figure 7:
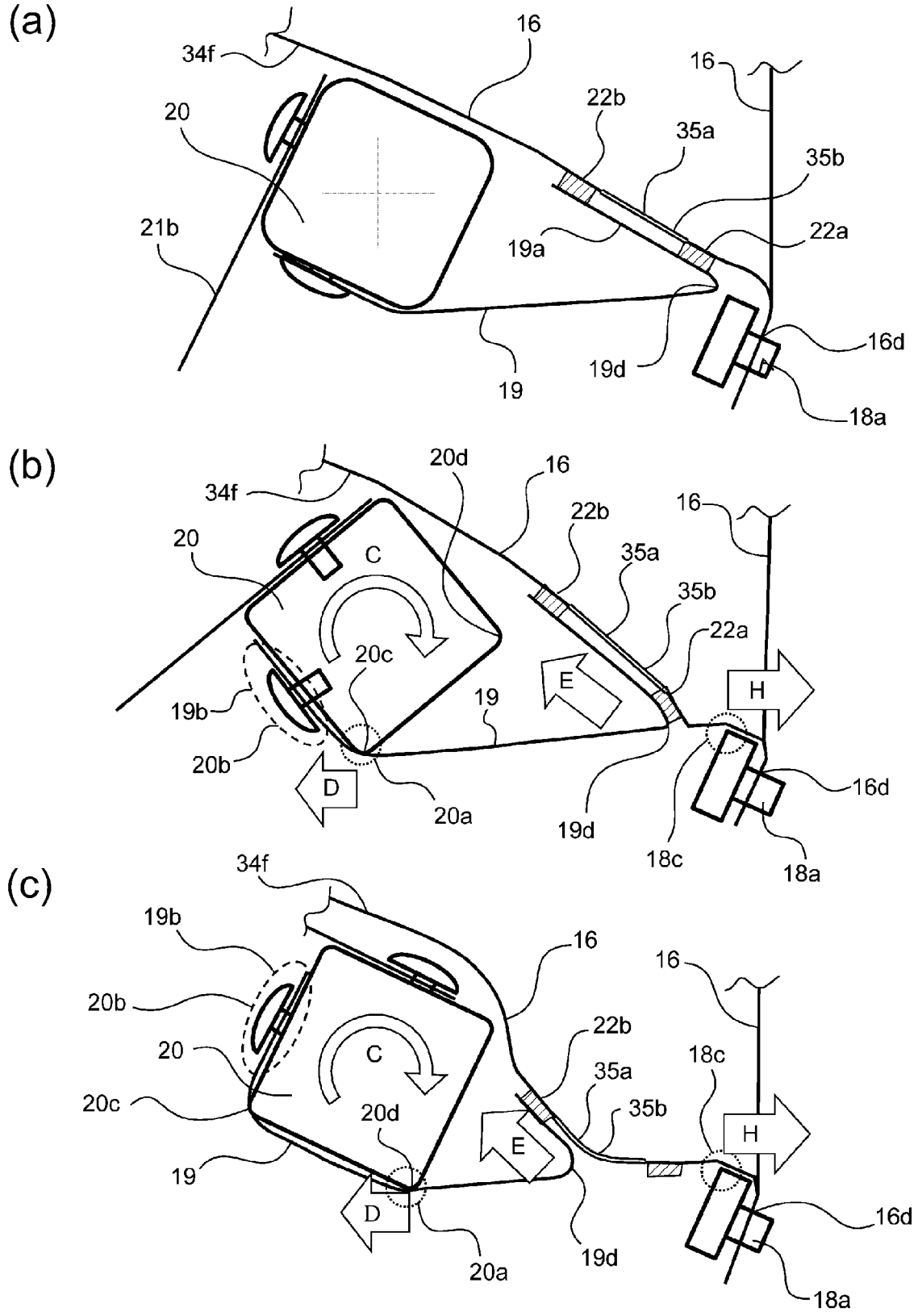
Figure 8:
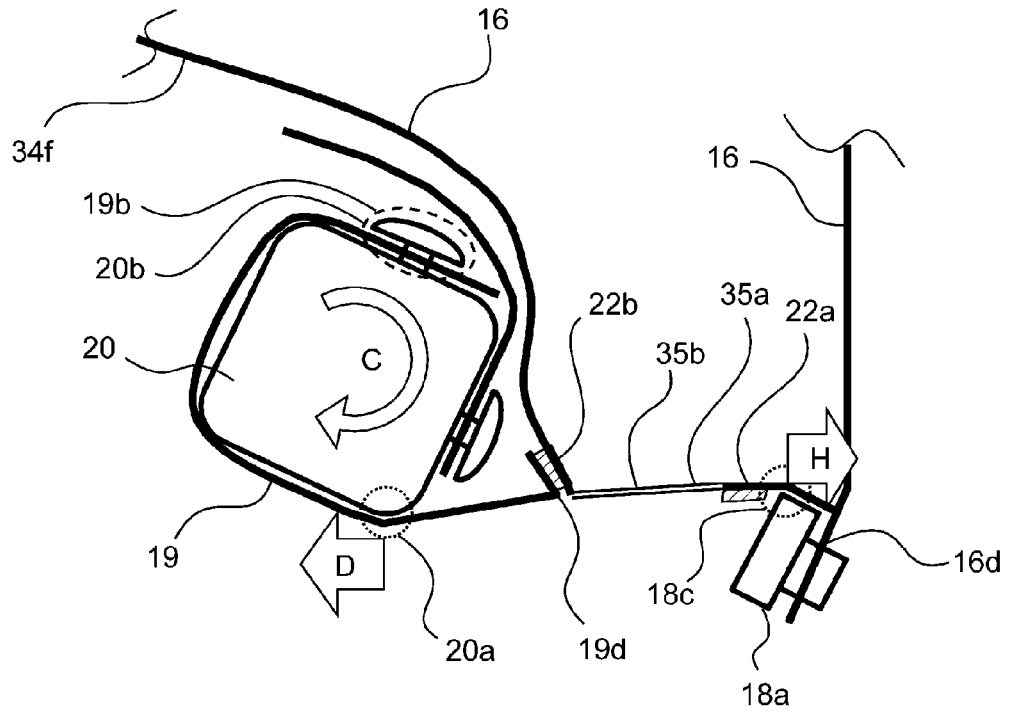
Figure 8:
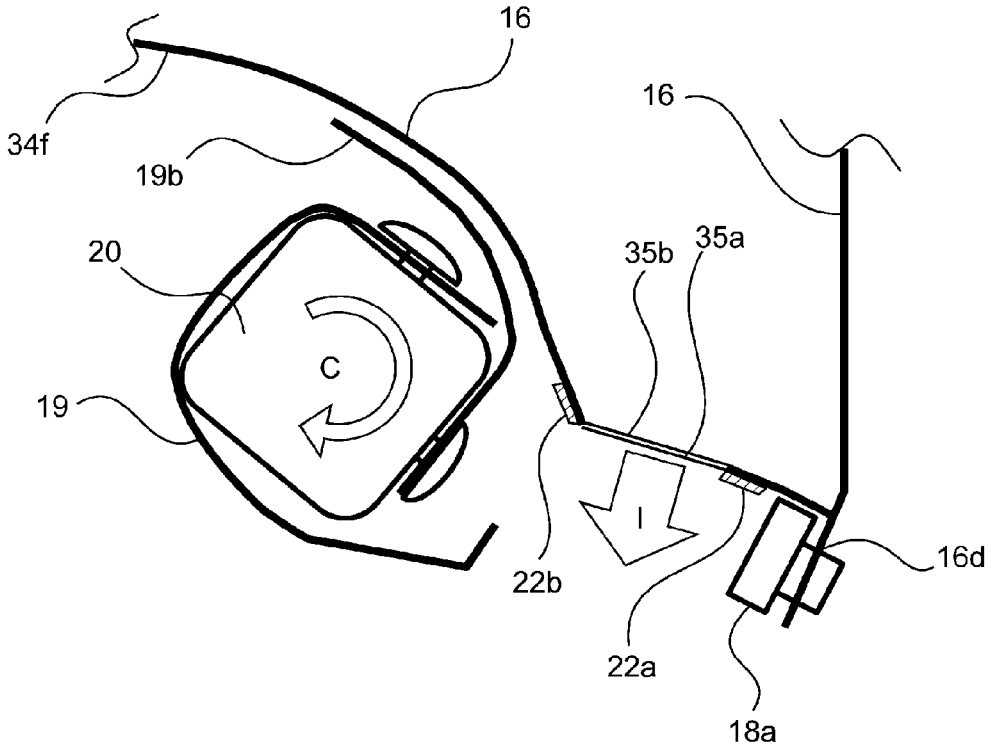
Figure 9:
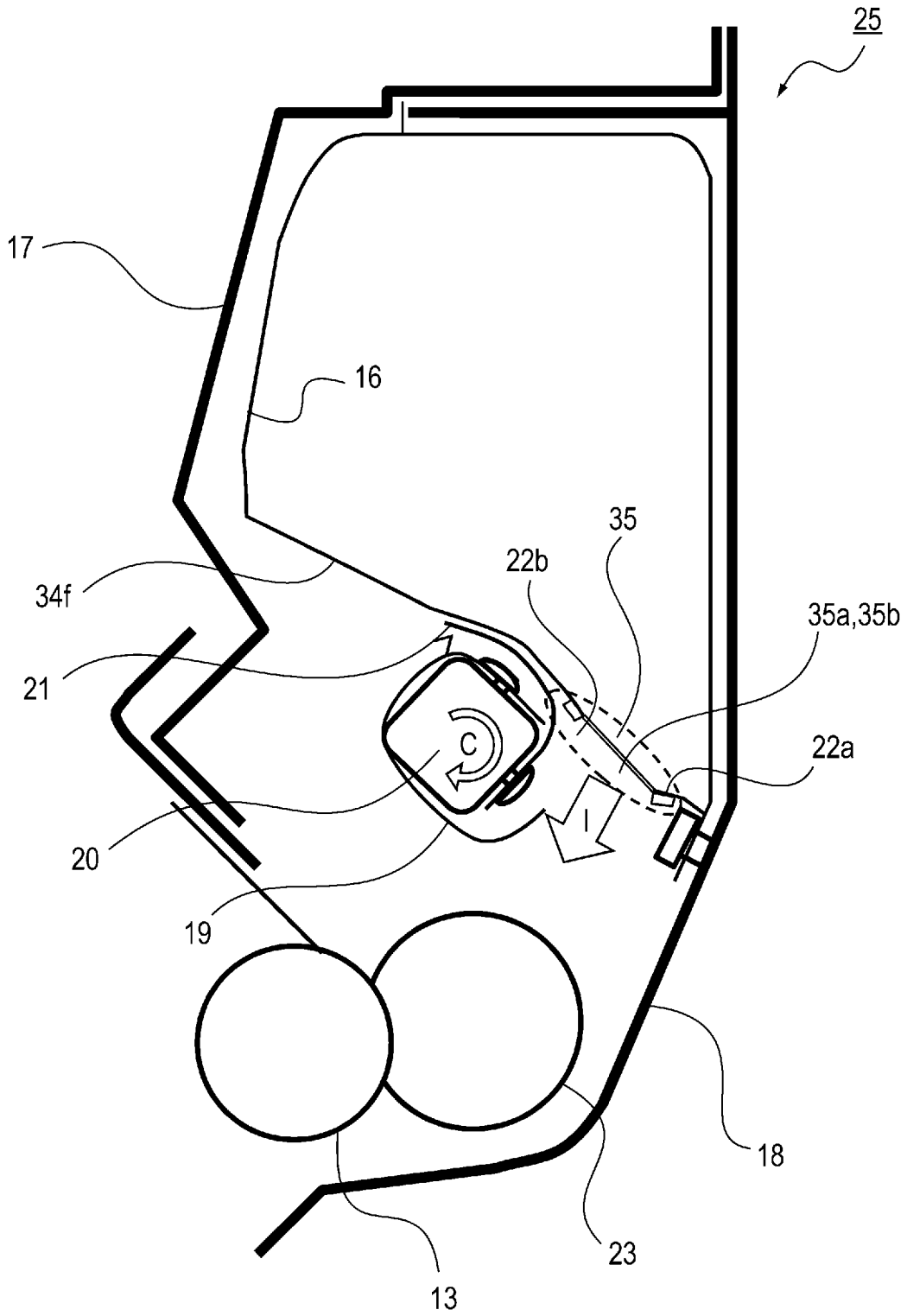

Parts (*a*) to (*c*) of FIG. 7, (*a*) and (*b*) of FIG. 8, and FIG. 9 are sectional views for illustrating an operation of a sealing member.

Figure 10:
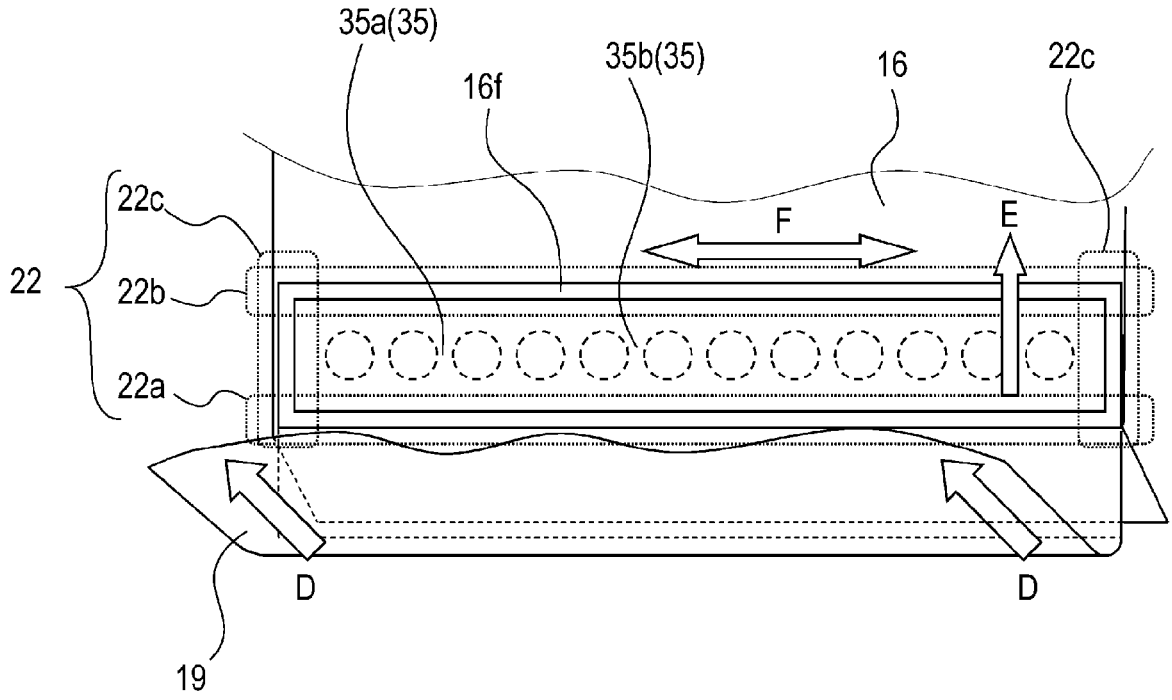

FIG. 10 is a plan view showing a structure of a discharging portion.

Figure 11:
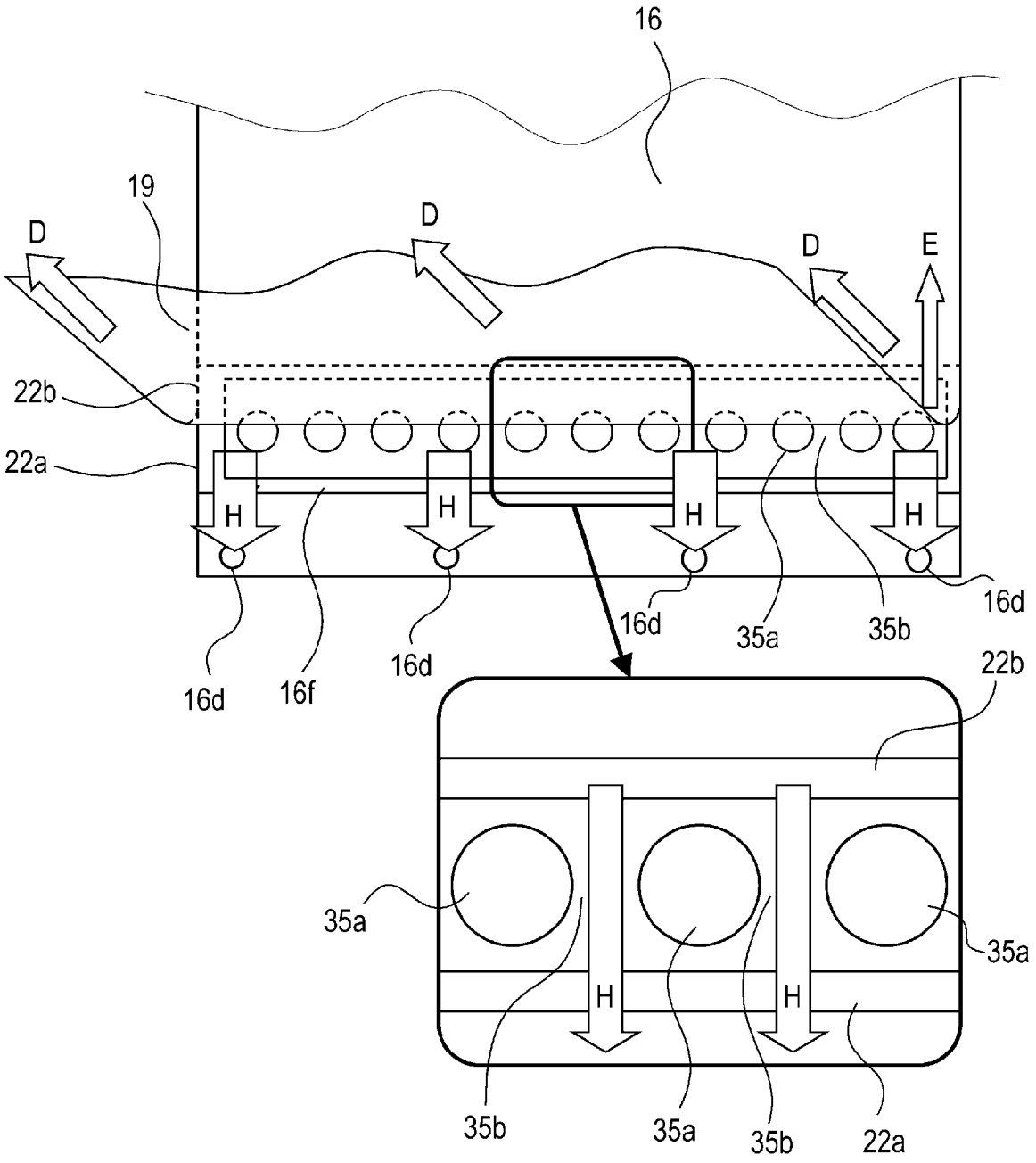

FIG. 11 is an enlarged plan view showing the structure of the discharging portion.

Figure 12:
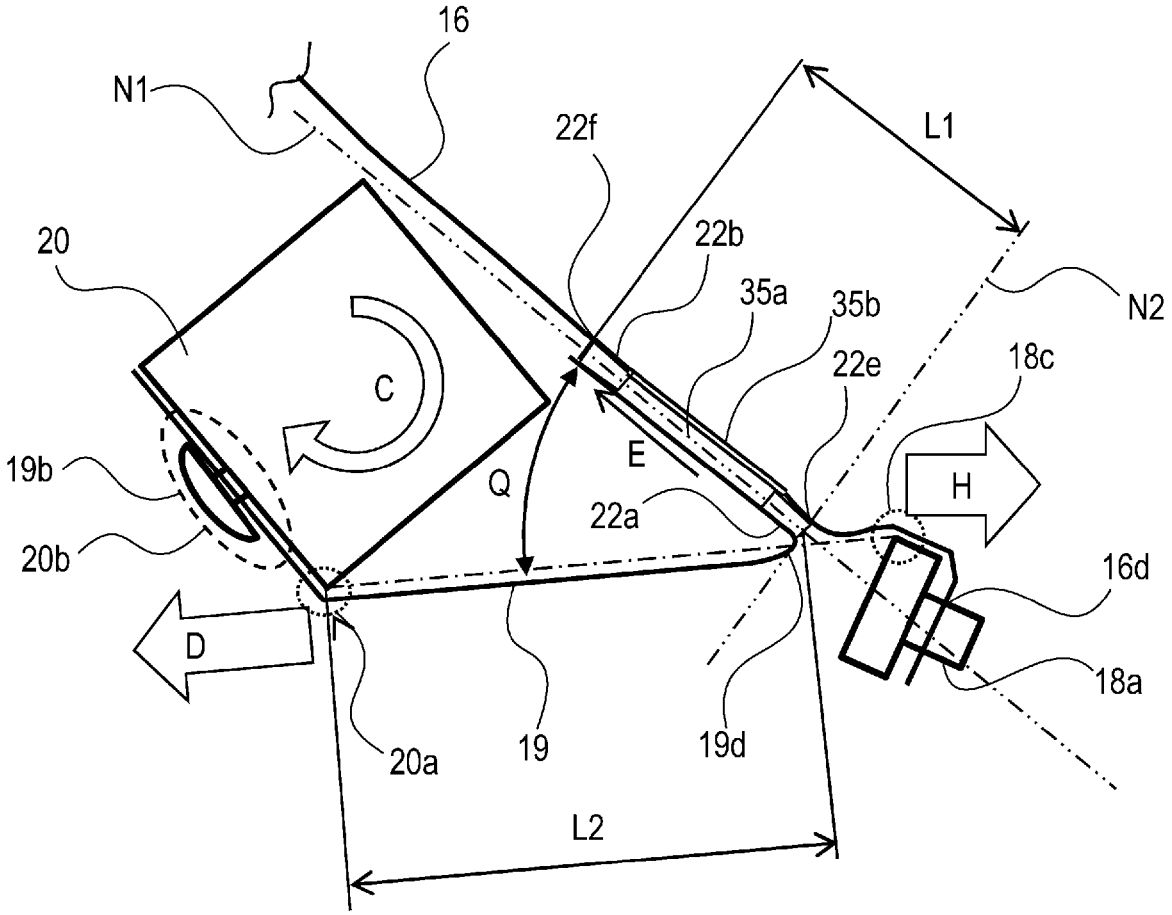

FIG. 12 is a sectional view for illustrating a dimensional relationship of the sealing member.

Figure 13:
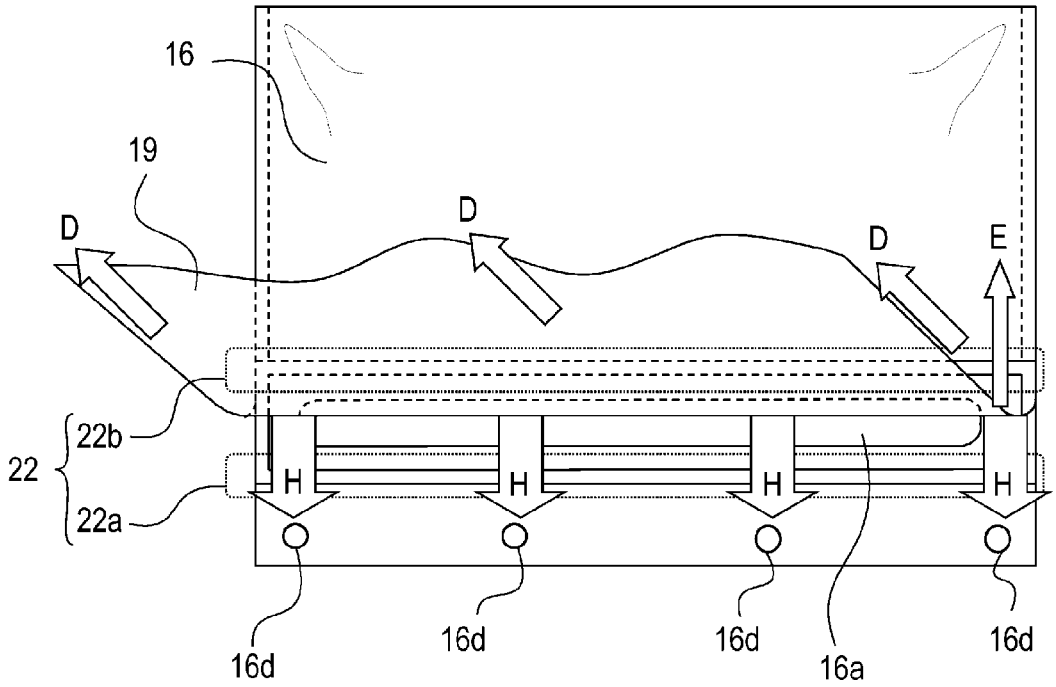
Figure 13:
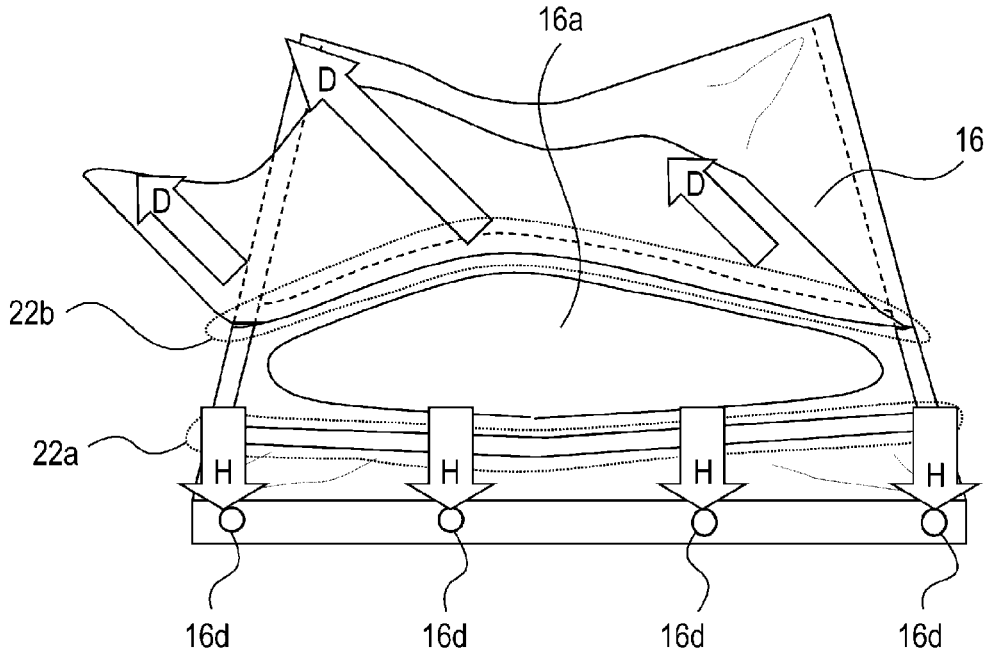

Parts (*a*) and (*b*) of FIG. 13 are schematic views showing a structure of the flexible container.

Figure 14:
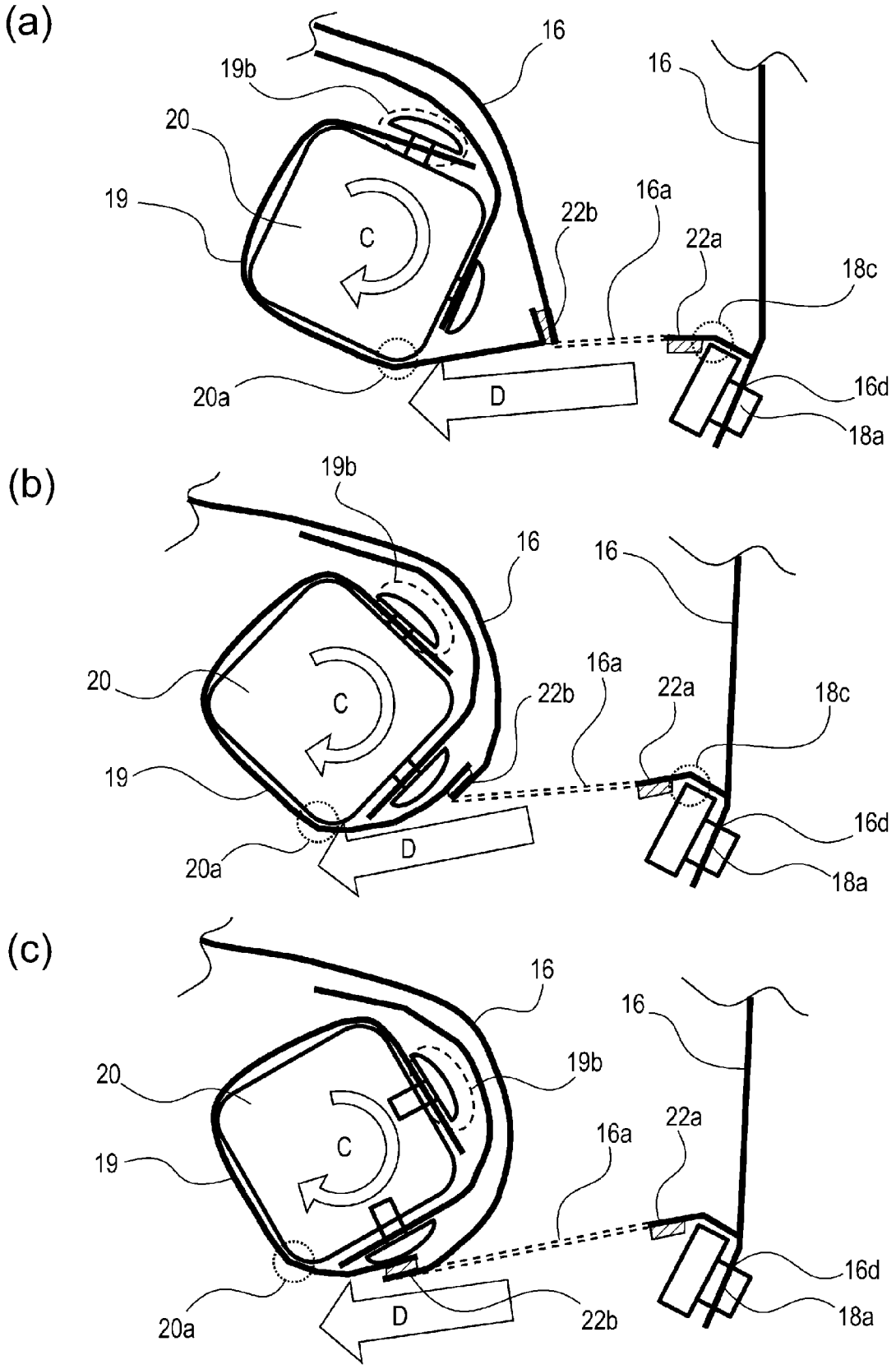

Parts (*a*) to (*c*) of FIG. 14 are sectional views for illustrating an operation of the sealing member.

Figure 15:
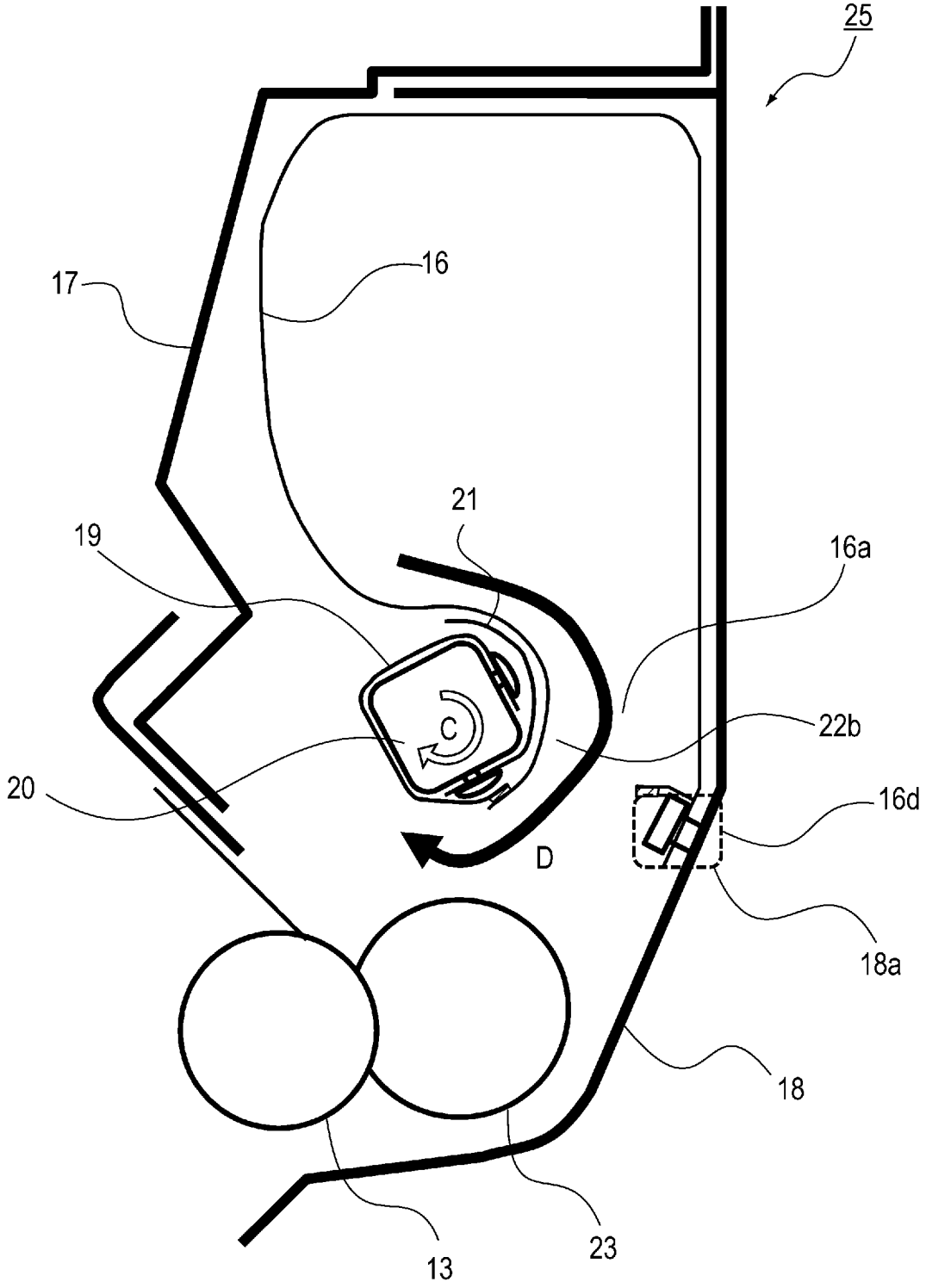
Figure 16:
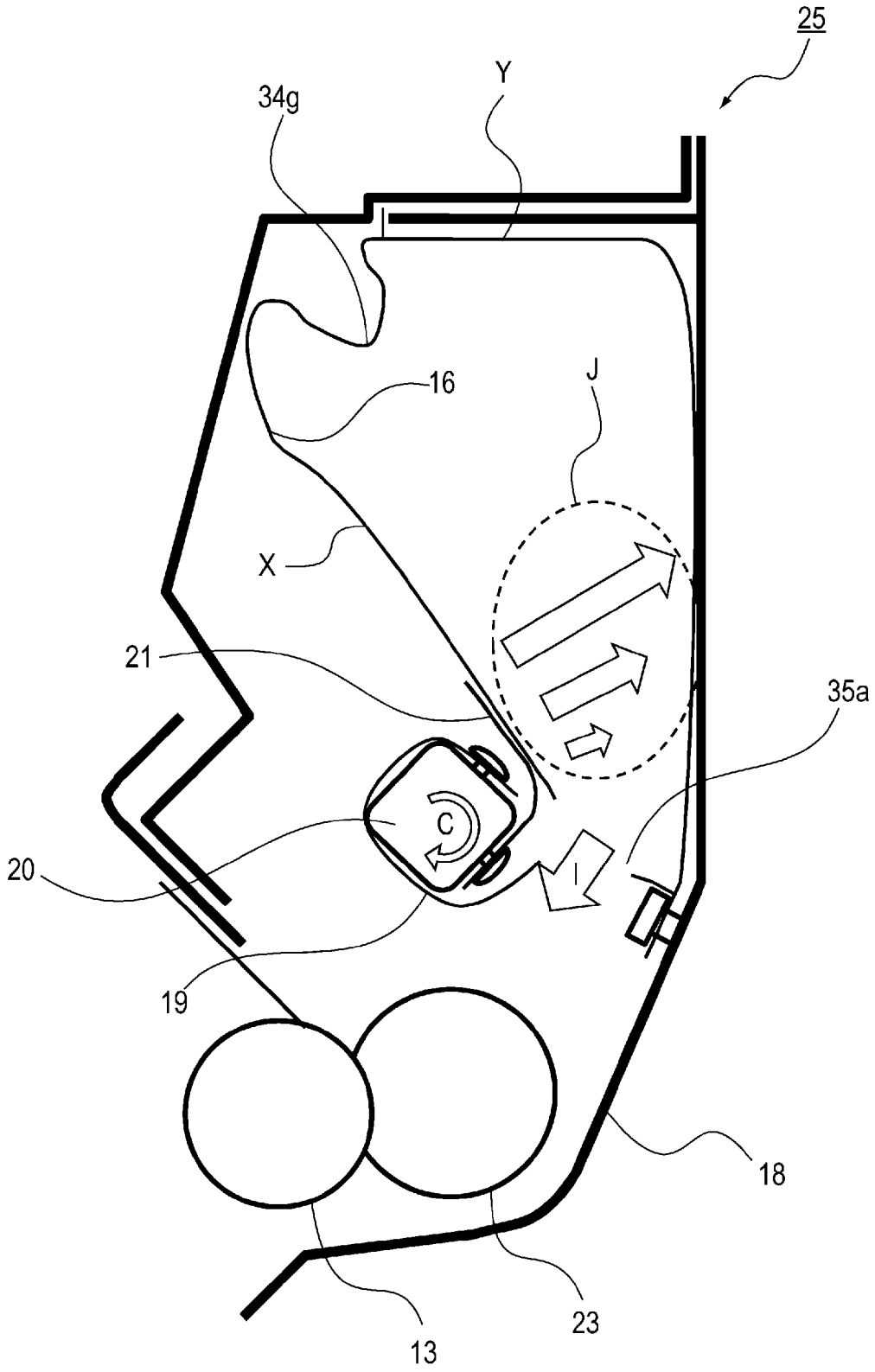
Figure 17:
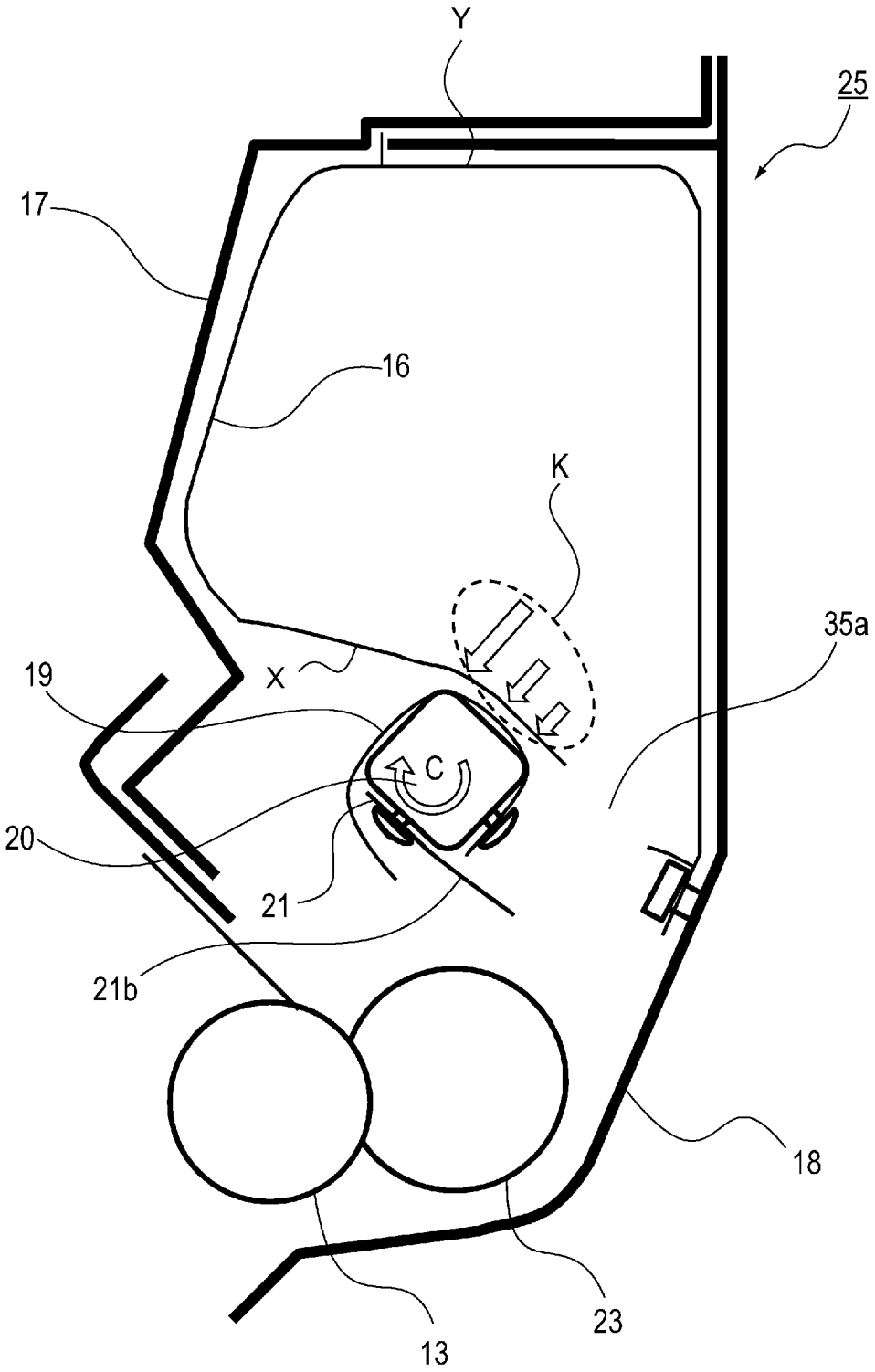

FIGS. 15 to 17 are sectional views for illustrating an operation of the flexible container inside the frame.

Figure 18:
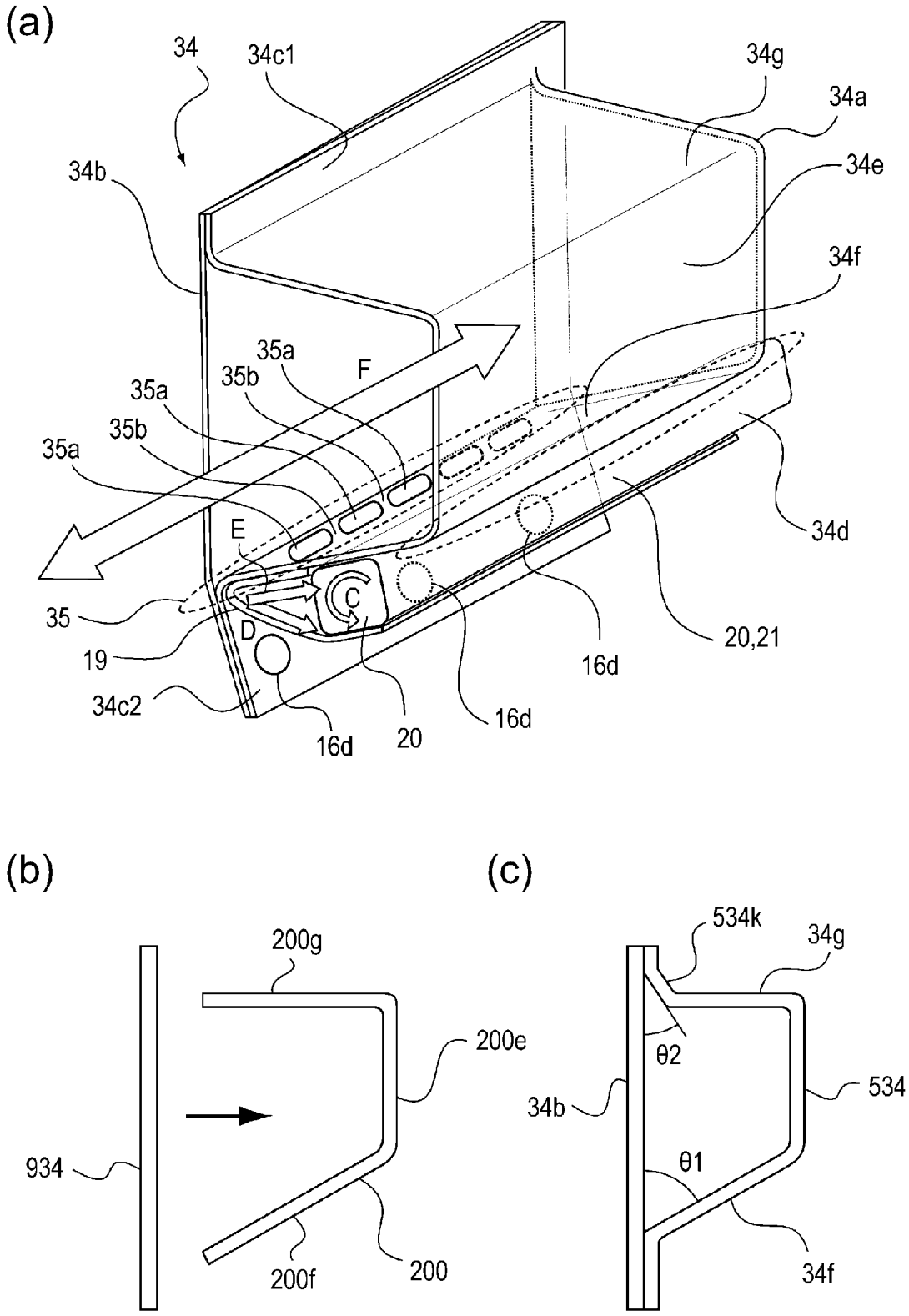

Parts (*a*) to (*c*) of FIG. 18 are schematic views for illustrating a structure of a developer accommodating member.

Figure 19:
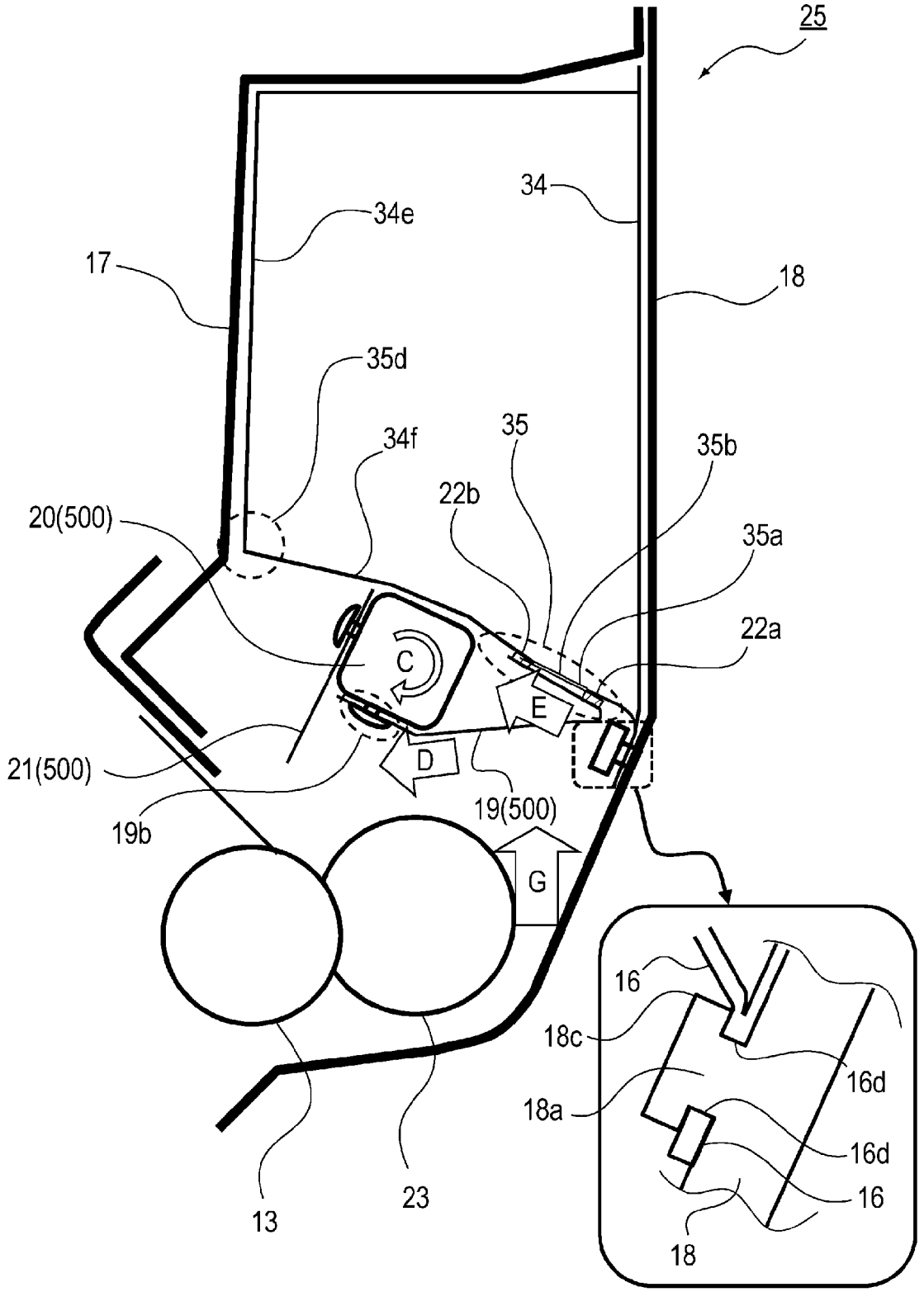

FIG. 19 is a sectional view showing an inside structure of the frame.

Figure 20:
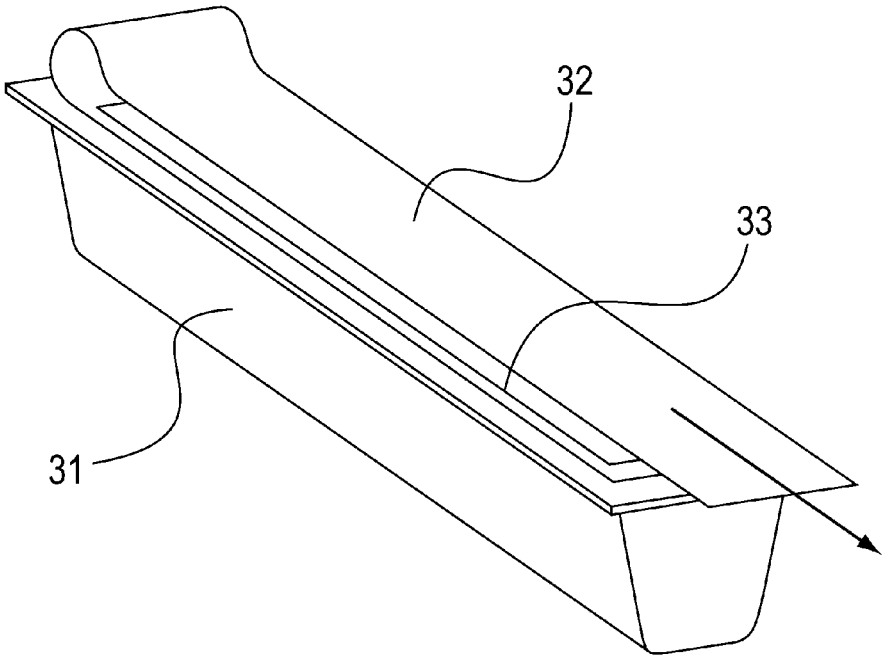

FIG. 20 is a perspective view showing a structure of a developer accommodating frame in a conventional example.

Figure 21:
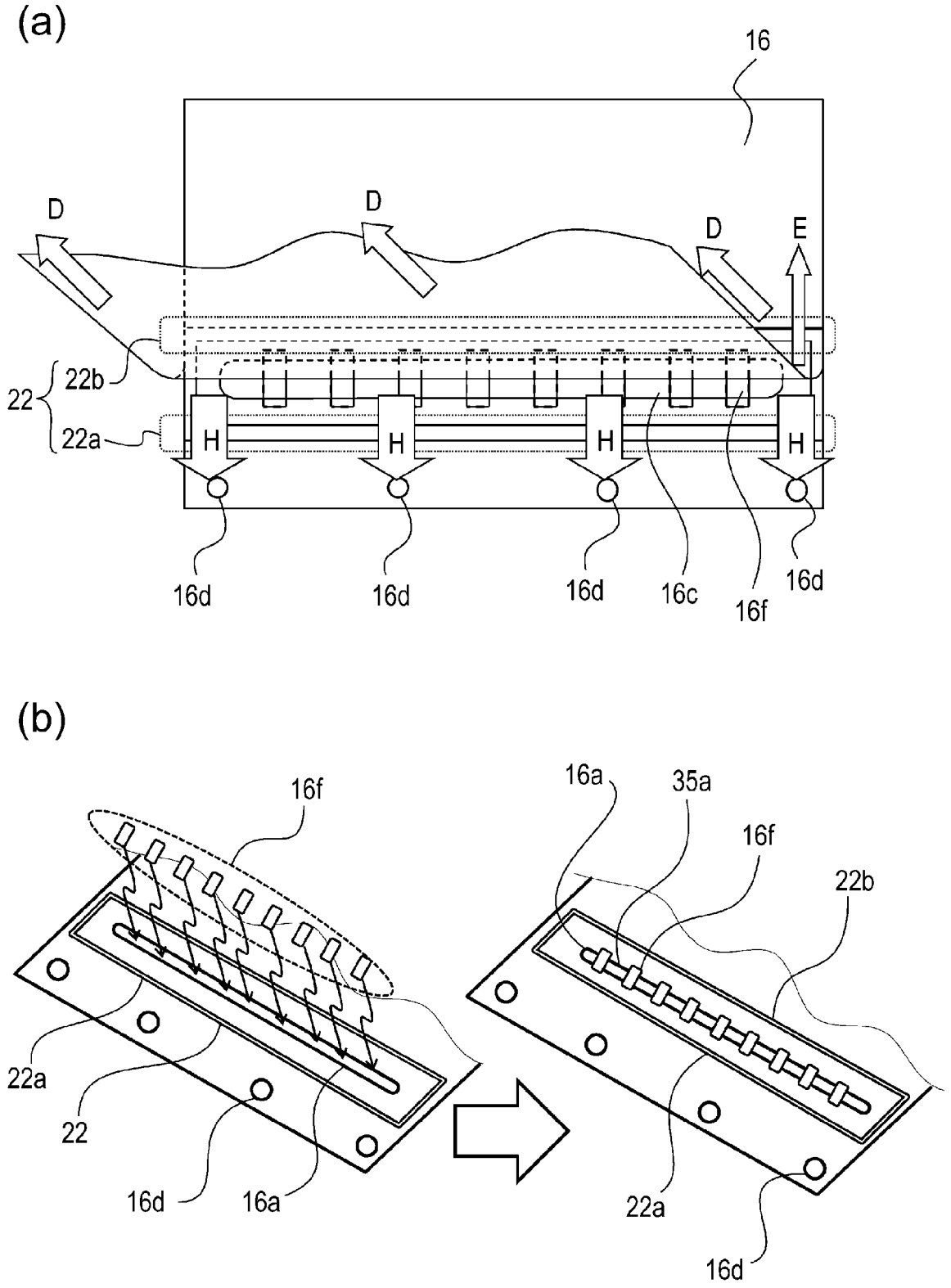

Parts (*a*) and (*b*) of FIG. 21 are schematic views for illustrating a structure of the discharging portion.

Figure 22:
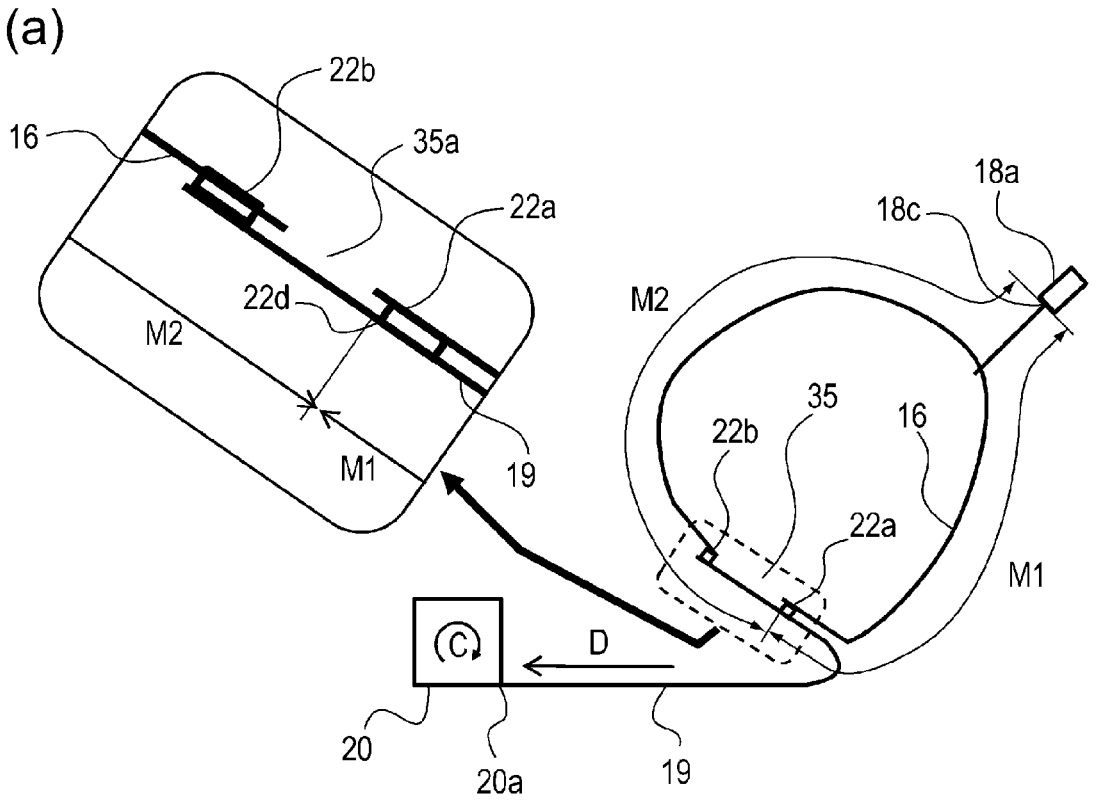
Figure 22:
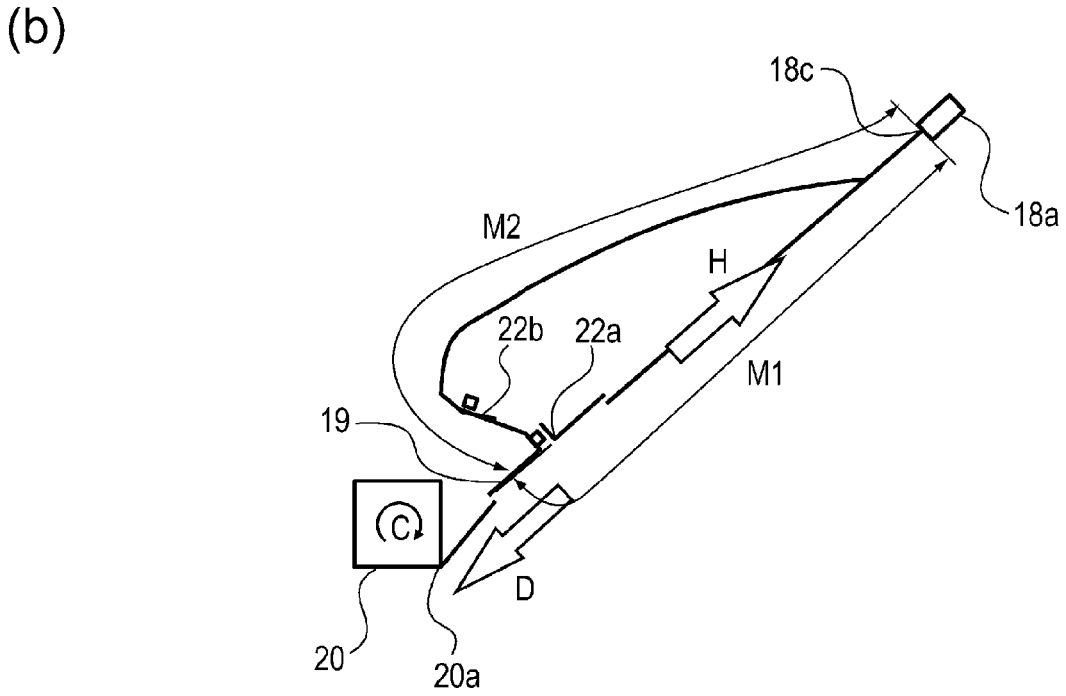
Figure 23:
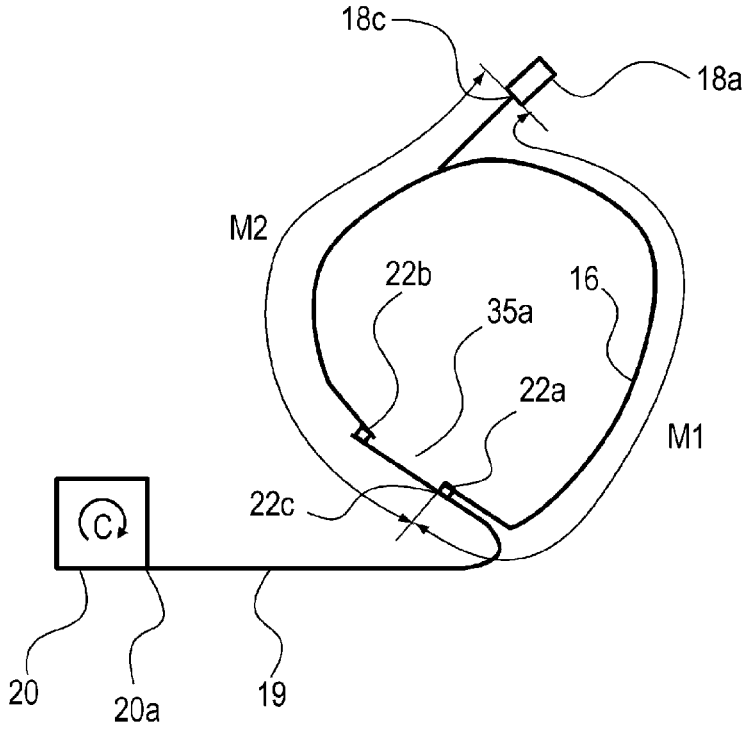
Figure 23:
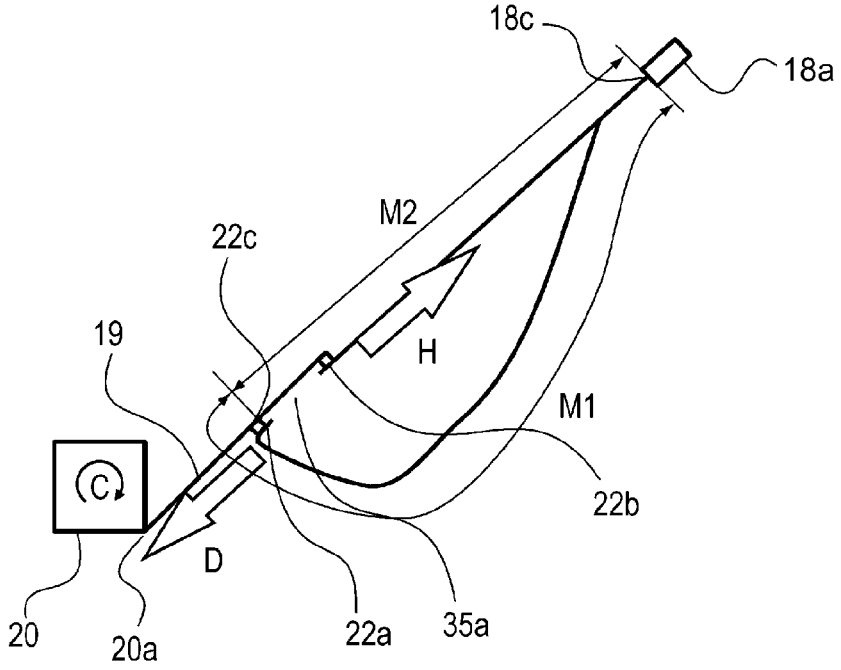
Figure 24:
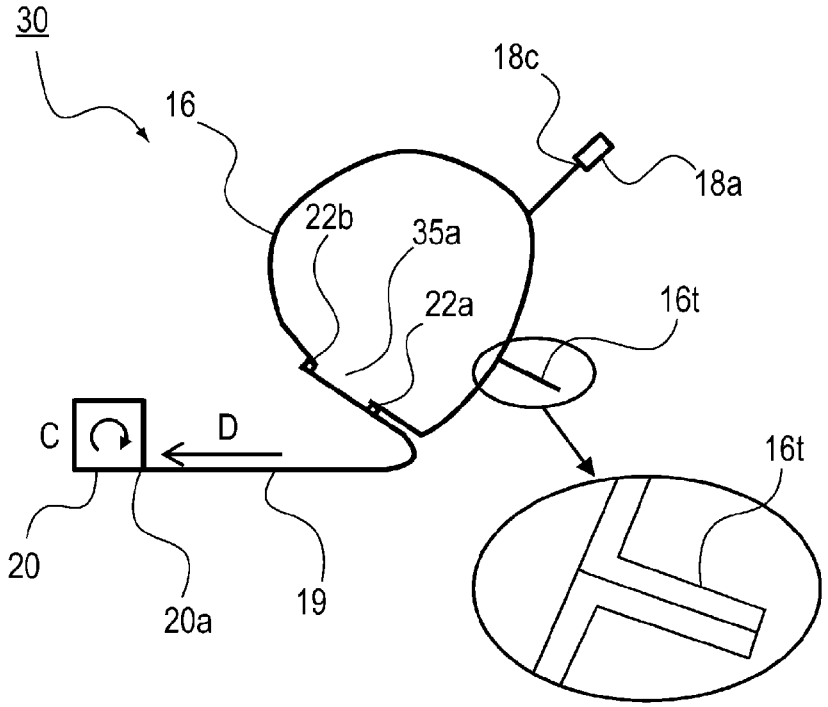
Figure 24:
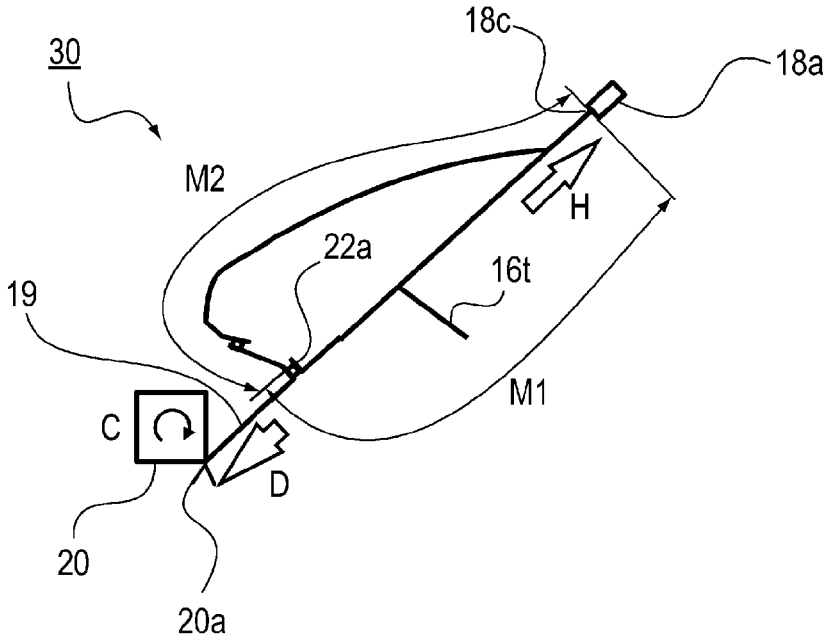

Parts (*a*) and (*b*) of FIG. 22, (*a*) and (*b*) of FIG. 23, and (*a*) and (*b*) of FIG. 24 are sectional views for illustrating a bonding portion.

Figure 25:
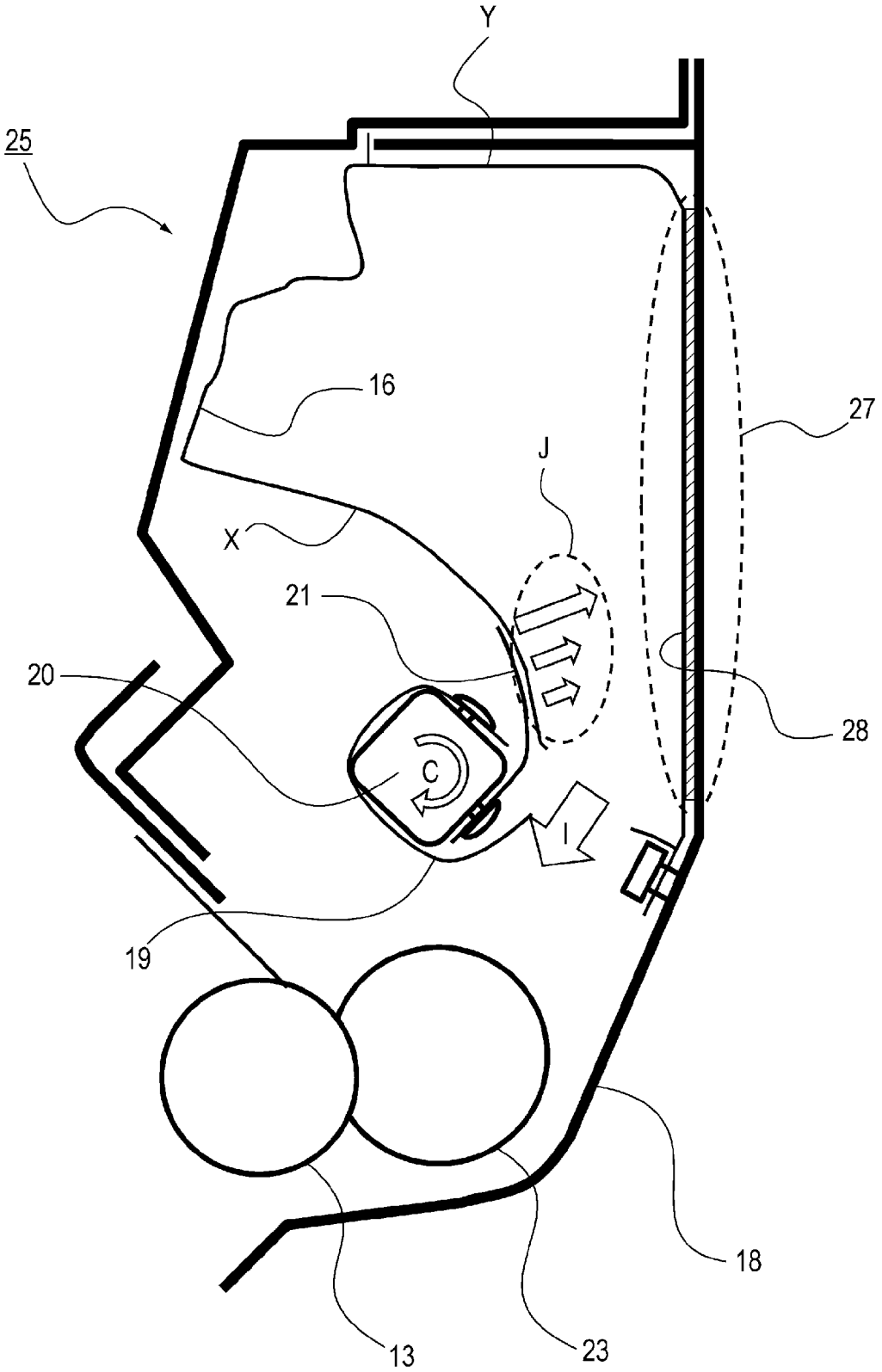

FIG. 25 is a sectional view for illustrating an operation of the sealing member.

Figure 26:
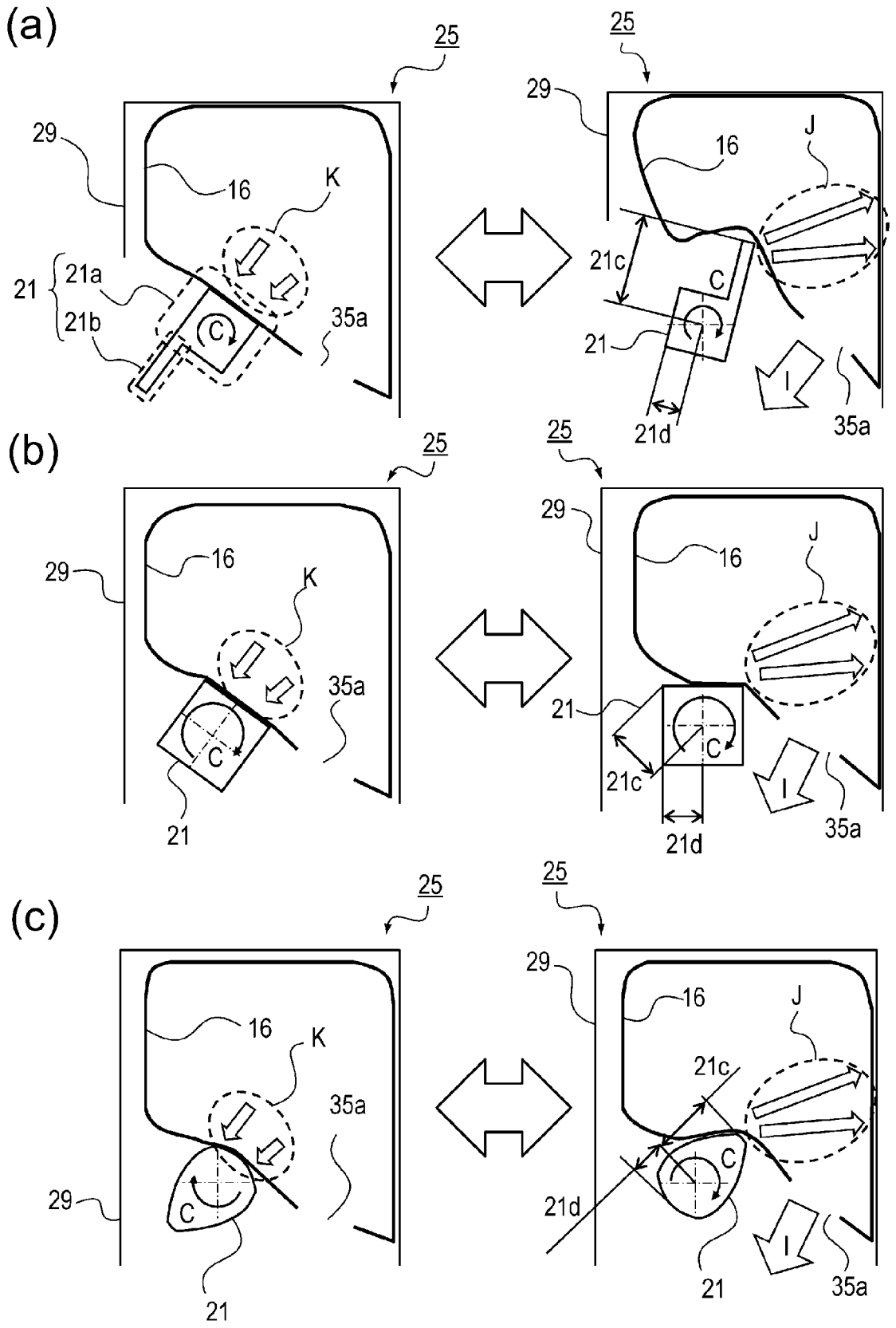

Parts (*a*) to (*c*) of FIG. 26 are sectional views each showing another structure of the urging member.

Figure 27:
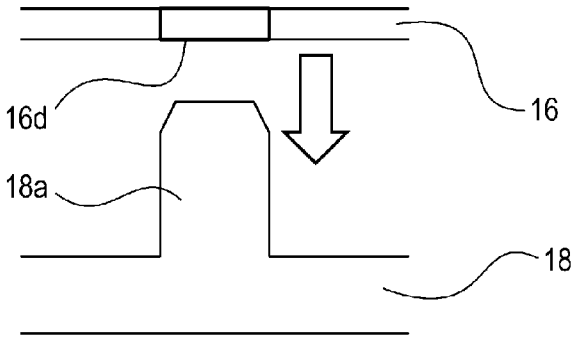
Figure 27:
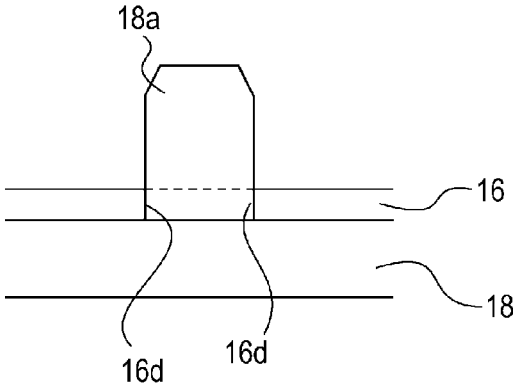
Figure 27:
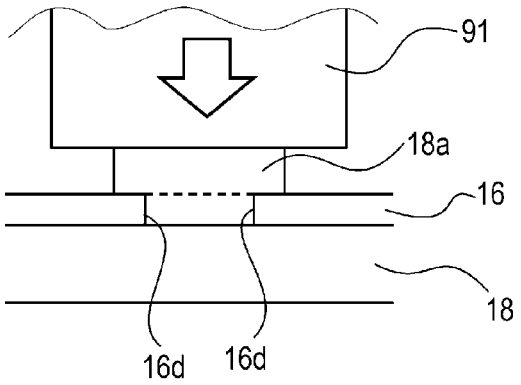
Figure 27:
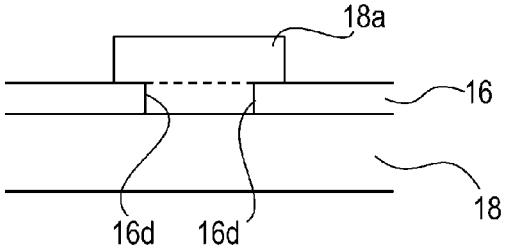

Parts (*a*) to (*d*) of FIG. 27 are sectional views for illustrating steps for fixing the flexible container to the frame.

Figure 28:
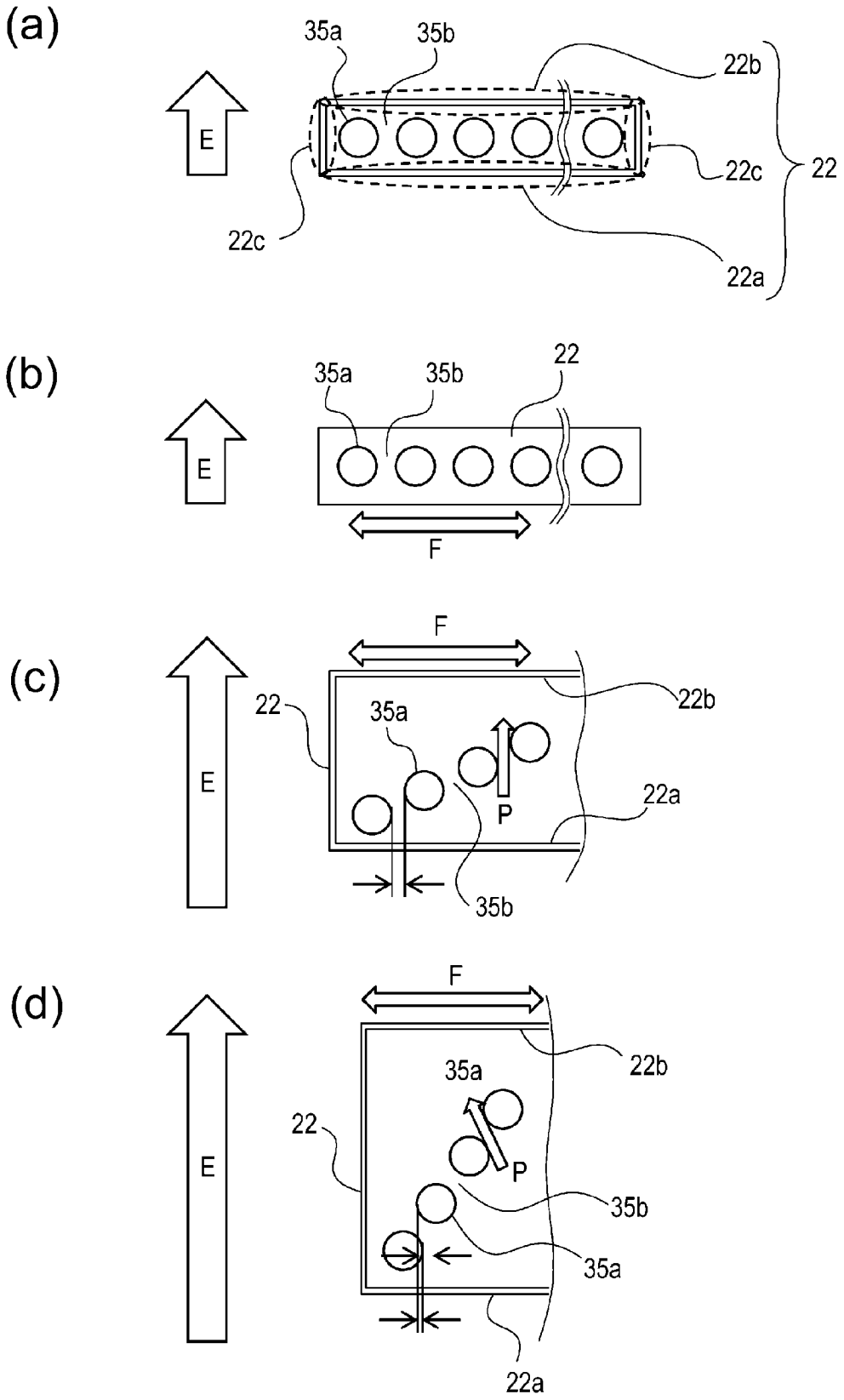

Parts (*a*) to (*d*) of FIG. 28 are plan views each showing a structure of the discharging portion.

Figure 29:
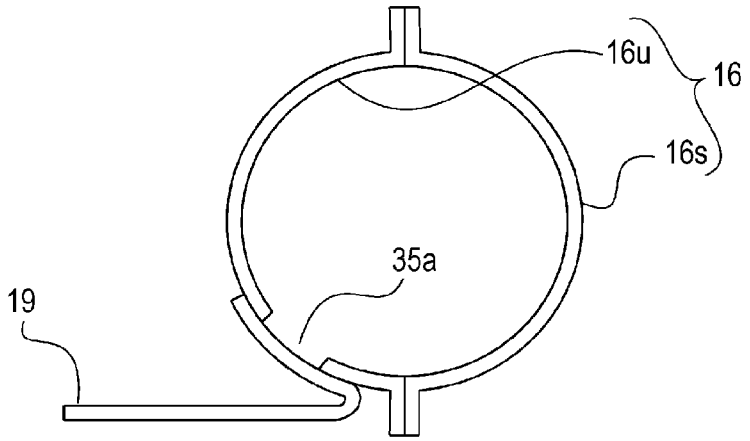
Figure 29:
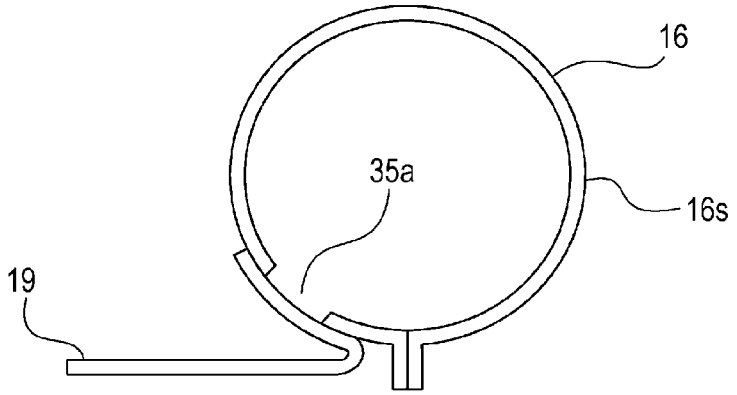
Figure 29:
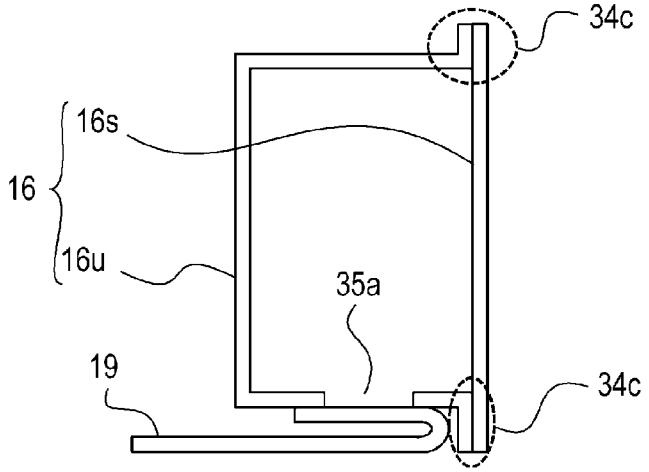

Parts (*a*) to (*c*) of FIG. 29 are sectional views each showing a structure of the flexible container.

Figure 30:
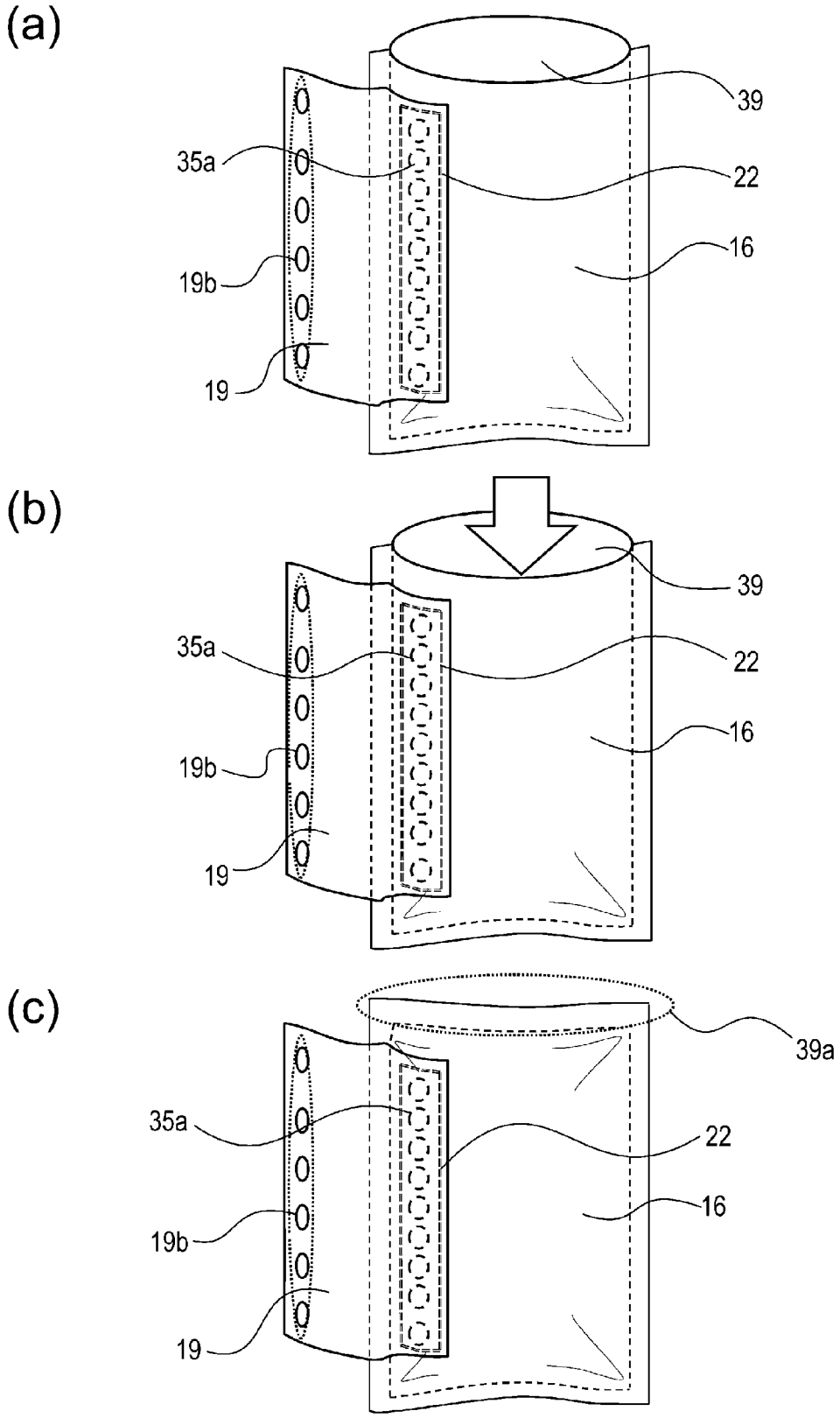

Parts (*a*) to (*c*) of FIG. 30 are side (perspective) views for illustrating the structure of the flexible container.

Figure 31:
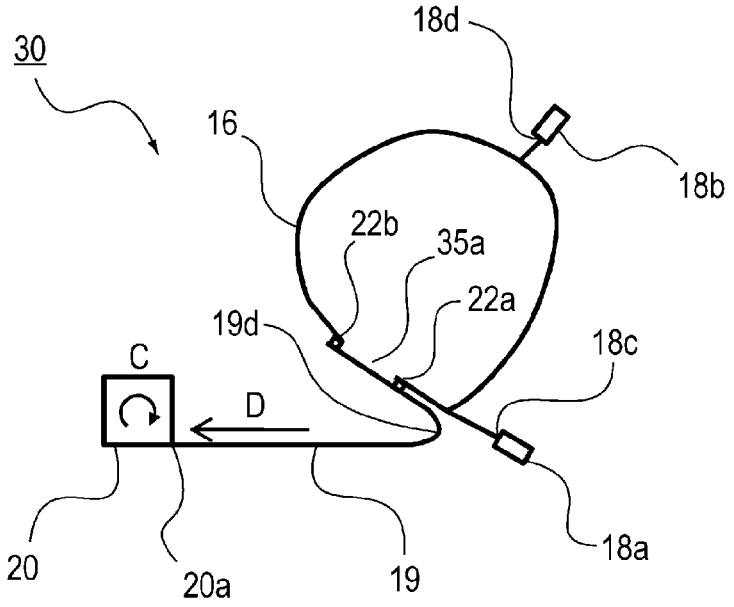
Figure 31:
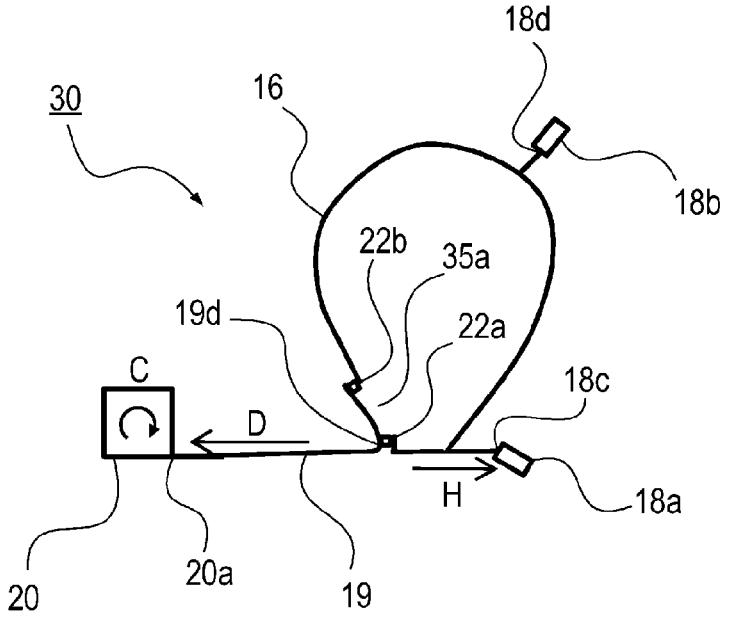

Parts (*a*) and (*b*) of FIG. 31 are sectional views for illustrating a state of the bonding portion.

Figure 32:
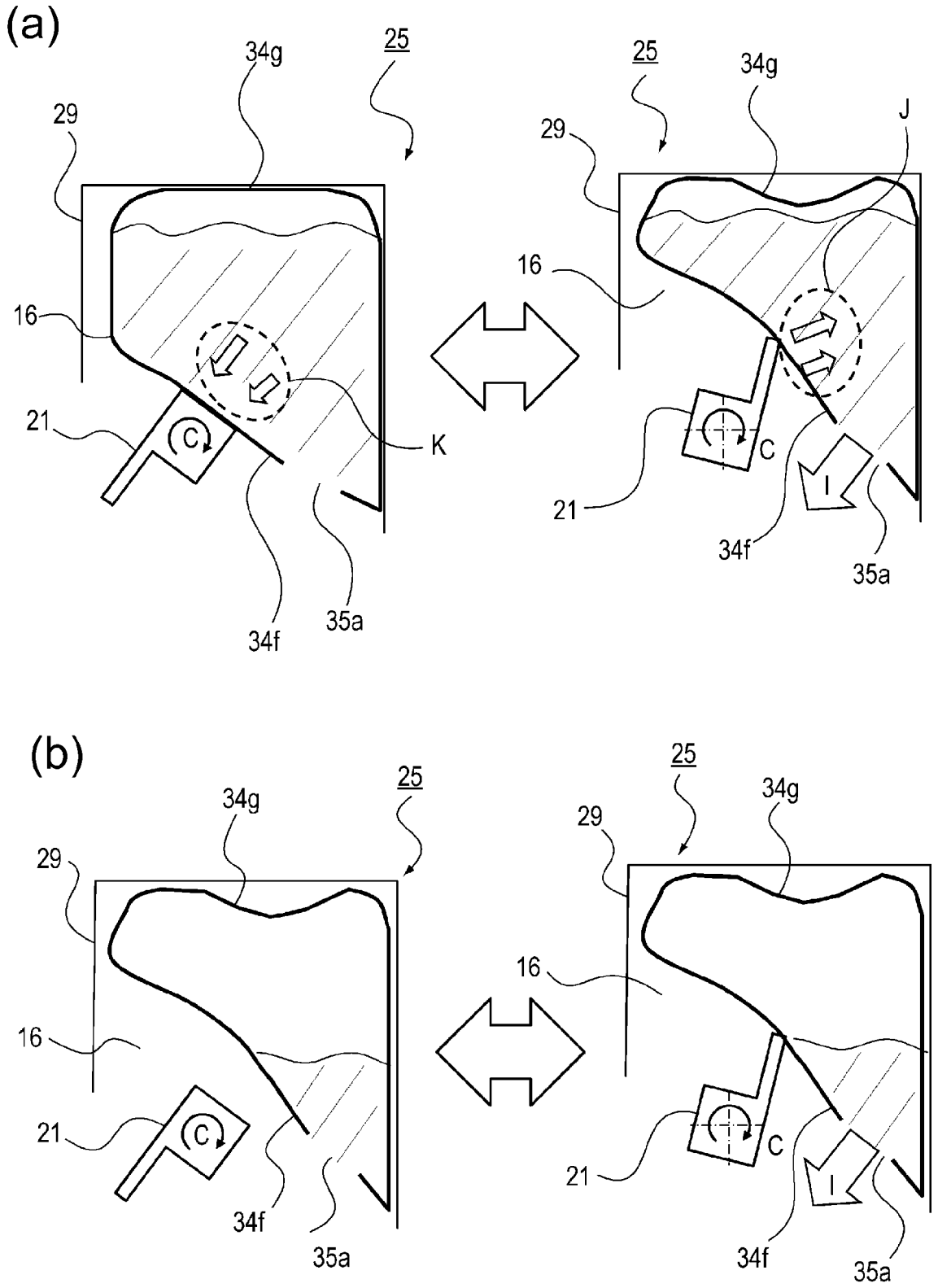

Parts (*a*) and (*b*) of FIG. 32 are sectional views for illustrating an operation of the flexible container.

DESCRIPTION OF THE PREFERRED EMBODIMENTS

[Embodiment 1]

Figure 2:
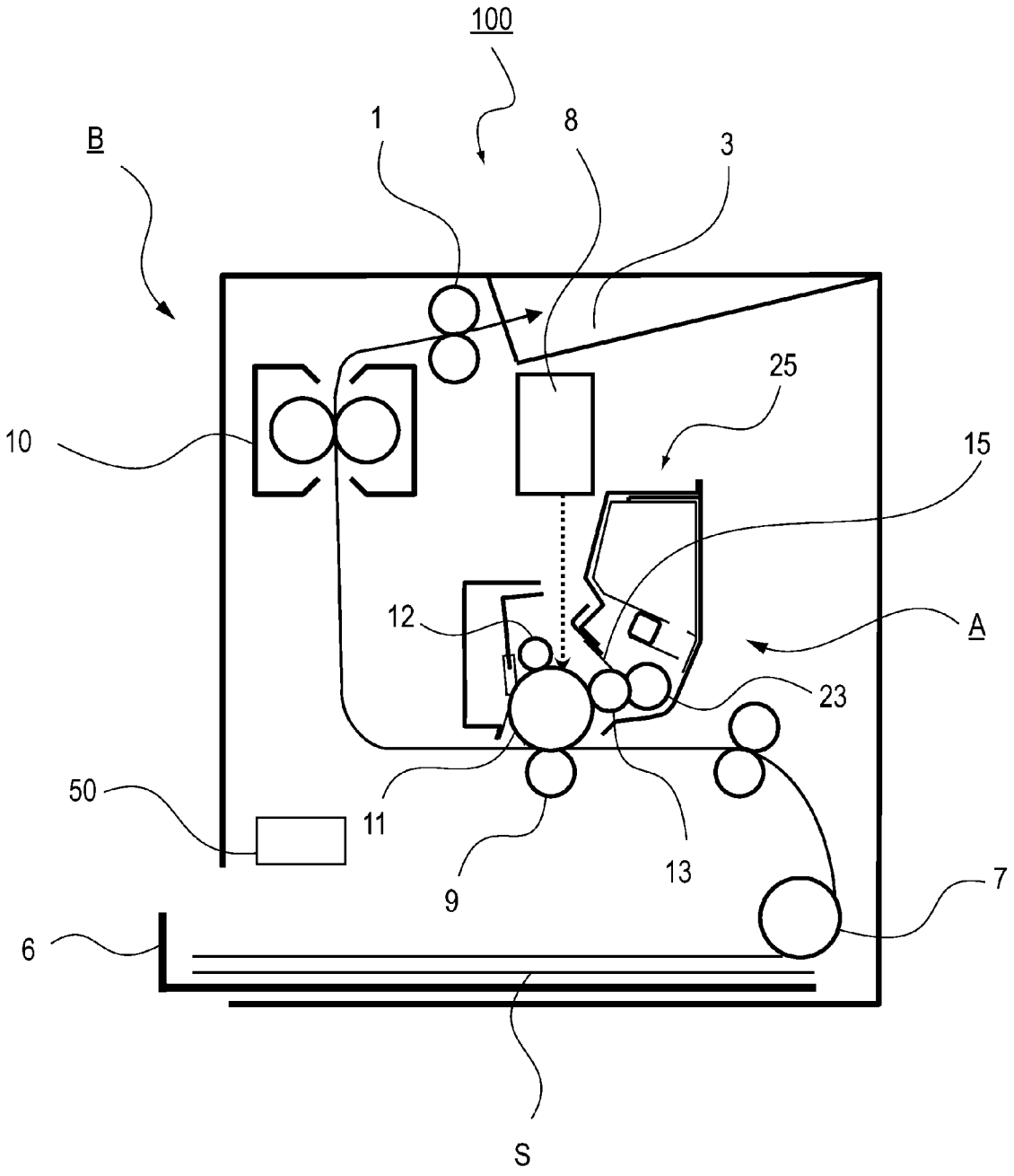
FIG. 2 is a sectional view showing a structure of an image forming apparatus.

FIG. 2 is a sectional view showing a structure of an image forming apparatus 100. As shown in FIG. 2, the image forming apparatus 100 as an electrophotographic image forming apparatus includes an apparatus main assembly B as an image forming apparatus main assembly and is constituted so that a cartridge A as a process cartridge is detachably mountable to the apparatus main assembly B. The cartridge A is prepared by integrally assembling a photosensitive drum 1 and a developer accommodating unit 25. In a sheet cassette 6 mounted to a lower portion of the apparatus main assembly B, sheets S are accommodated. During image formation, the sheet S is fed toward the photosensitive drum 11 as an electrophotographic photosensitive drum which is an image bearing member by a feeding roller 7.

In synchronism with this operation, the surface of the photosensitive drum 11 is electrically charged uniformly by a charging roller 12 and exposed to light by an exposure device 8, so that an electrostatic latent image is formed on the surface of the photosensitive drum 11. In the cartridge A, a developer is accommodated and a developing roller 13 as a developer carrying member is provided. The developer is fed to the developing roller 13 by a supplying roller 23 to be carried in a thin layer on the surface of the developing roller 13 by a developing blade 15. Then, a developing bias is applied to the developing roller 13, so that the above-described electrostatic latent image is developed with the developer and thus a developer image is formed on the surface of the photosensitive drum 11.

The developer image is transferred onto the conveyed sheet S by a transfer roller 9 supplied with a bias voltage. Then, the sheet S is conveyed to a fixing device 10 to fix the developer image thereon, and then is discharged onto a discharge portion 3. Incidentally, the apparatus main assembly B includes a controller 50, and the controller 50 controls drive of inside devices of the apparatus main assembly B.

Further, although described later, the controller 50 controls drive of an urging sheet 21 (FIG. 1) so that the urging sheet 21 can repetitively urge a flexible container 26 (FIG. 1) by rotating the urging sheet 21.

<Summary of Structure of Process Cartridge>

Figure 1:
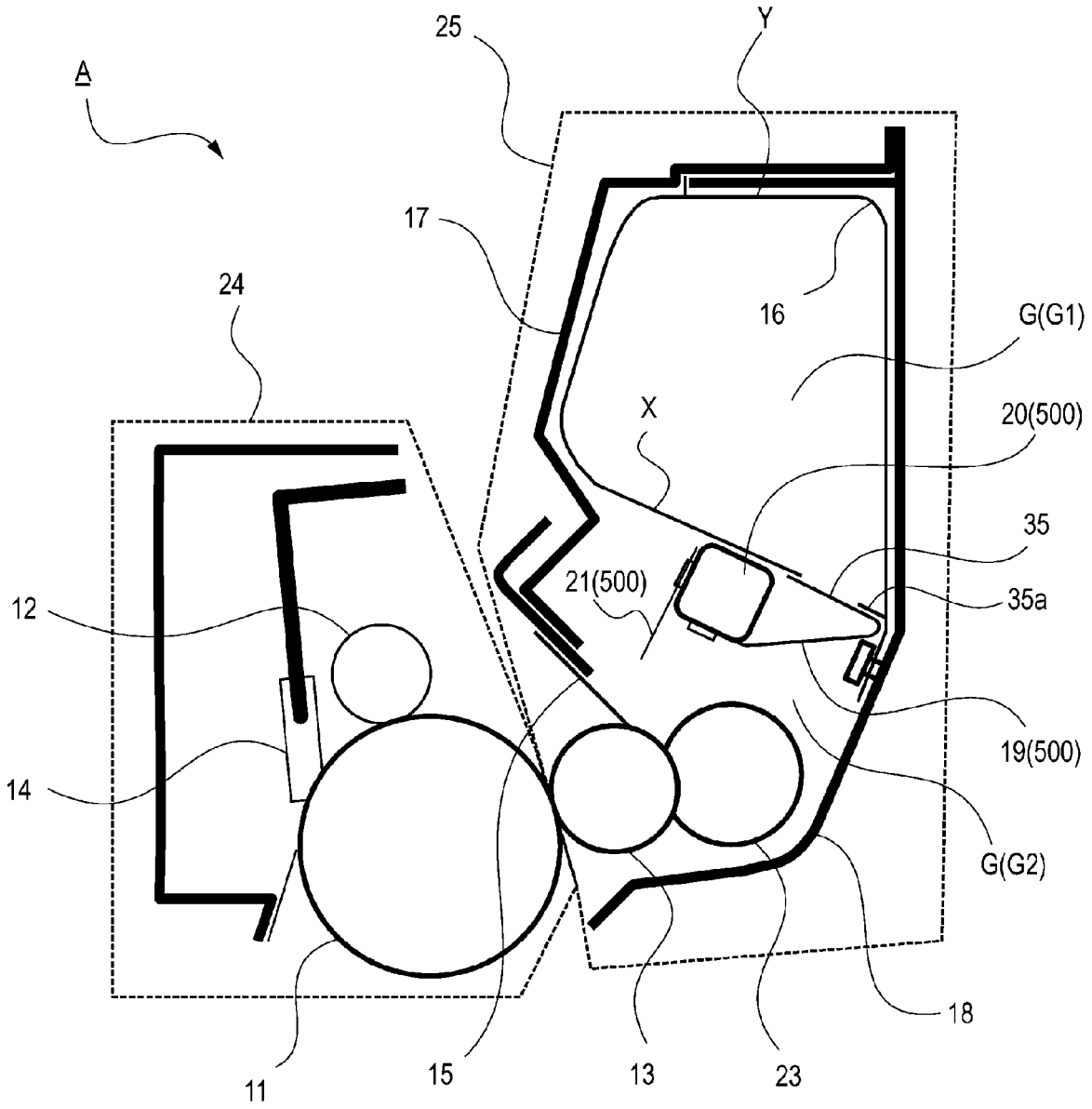
FIG. 1 is a sectional view showing a structure of a developer accommodating unit.

FIG. 1 is a sectional view showing a structure of the cartridge A. As shown in FIG. 1, the cartridge A includes a cleaner unit 24 and the developer accommodating unit 25. The cleaner unit 24 includes the photosensitive drum 11, a cleaning blade 14 for cleaning the surface of the photosensitive drum 11, and the charging roller 12 for electrically charging the surface of the photosensitive drum 11. The developer accommodating unit 25 includes the developing roller 13, the supplying roller 23 for supplying the developer to the developing roller 13, and the flexible container 16 for accommodating the developer. The developer accommodating unit 25 will be described specifically below.

The developer accommodating unit 25 includes a frame 17 as a first frame and a frame 18 as a second frame. In an upper region of the frames 17 and 18, the flexible container 16 and an urging member 500 (urging body or urging means) are disposed. The urging member 500 includes, although described later, the urging sheet 21, a sealing member 19 and a rotatable member 20. However, the present invention is characterized by the flexible container 16. The flexible container 16 is provided with openings 35*a* for permitting discharge of a developer G (G1), and is a container for accommodating the developer G (G1). In a lower region of the frames 17 and 18, the developing roller 13 and the supplying roller 23 are disposed. By employing such a constitution, the developer accommodating unit 25 is configured to accommodate the flexible container 16 containing the developer in the upper region of the frames 17 and 18 and to accommodate the developer G (G2) after being discharged from the flexible container 16 in the lower region of the frames 17 and 18.

The urging member 500 is disposed opposed to a lower side of the flexible container 16. On the rotatable member 20 of the urging member 500, the urging sheet 21 and the sealing member 19 are fixed. The sealing member 19 is a member for urging the flexible container 16 after the sealing member 19 seals the openings 35*a* and then unseals the openings 35*a* by rotation of the rotatable member 20. Further, the urging sheet 21 urges, during or after an operation in which the sealing member 19 unseals the openings 35*a*, the lower side of the flexible container 16 to deform the flexible container 16. The flexible container 16 has a plurality of sides including an opening-containing side X containing the openings 35*a* and another-side Y having stiffness lower than that of the opening-containing side X. Incidentally, a side of the flexible container 16 other than the opening-containing side X and the another-side Y may be formed with a member having stiffness equal to or larger than that of the opening-containing side X.

Thus, the flexible container 16 is configured to have the opening-containing side X containing the openings 35*a* and the another-side Y having stiffness lower than that of the opening-containing side X, and therefore the opening-containing side X is readily vibrated more than the another-side Y. For that reason, the developer G present at a periphery of the openings 35*a* is readily discharged through the openings 35*a*. As a result, the discharge of the developer G from the flexible container 16 can be satisfactorily performed.

Further, the stiffness of the opening-containing side X is higher than that of the another-side Y and therefore a shape of the openings 35*a* is not readily broken (deformed). Incidentally, the developing roller 13 and the developing blade 15 are supported by the frame 17.

<Summary of Structure of Developer Accommodating Unit>

Figure 3:
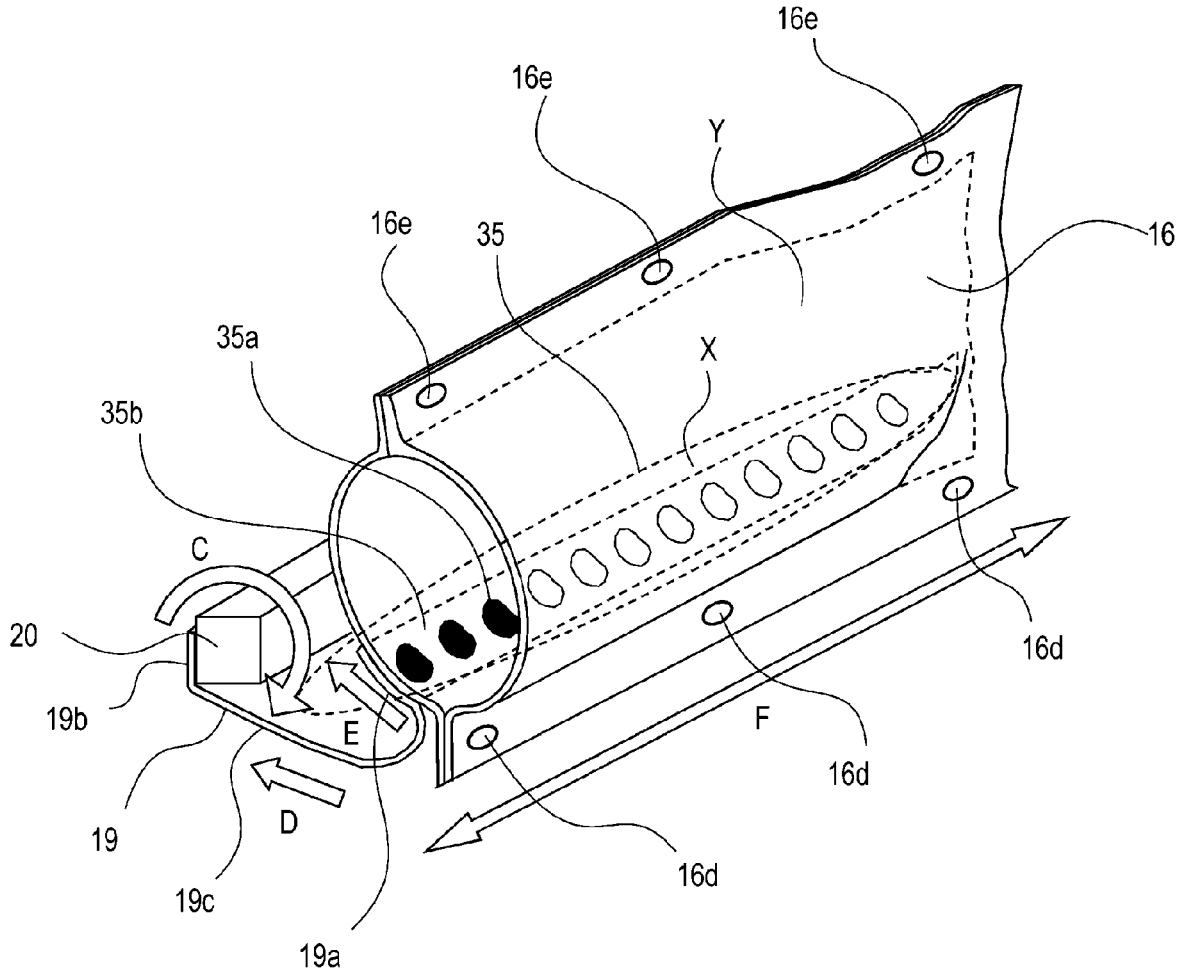
FIG. 3 is a perspective view showing a structure of a flexible container.
Figure 4:
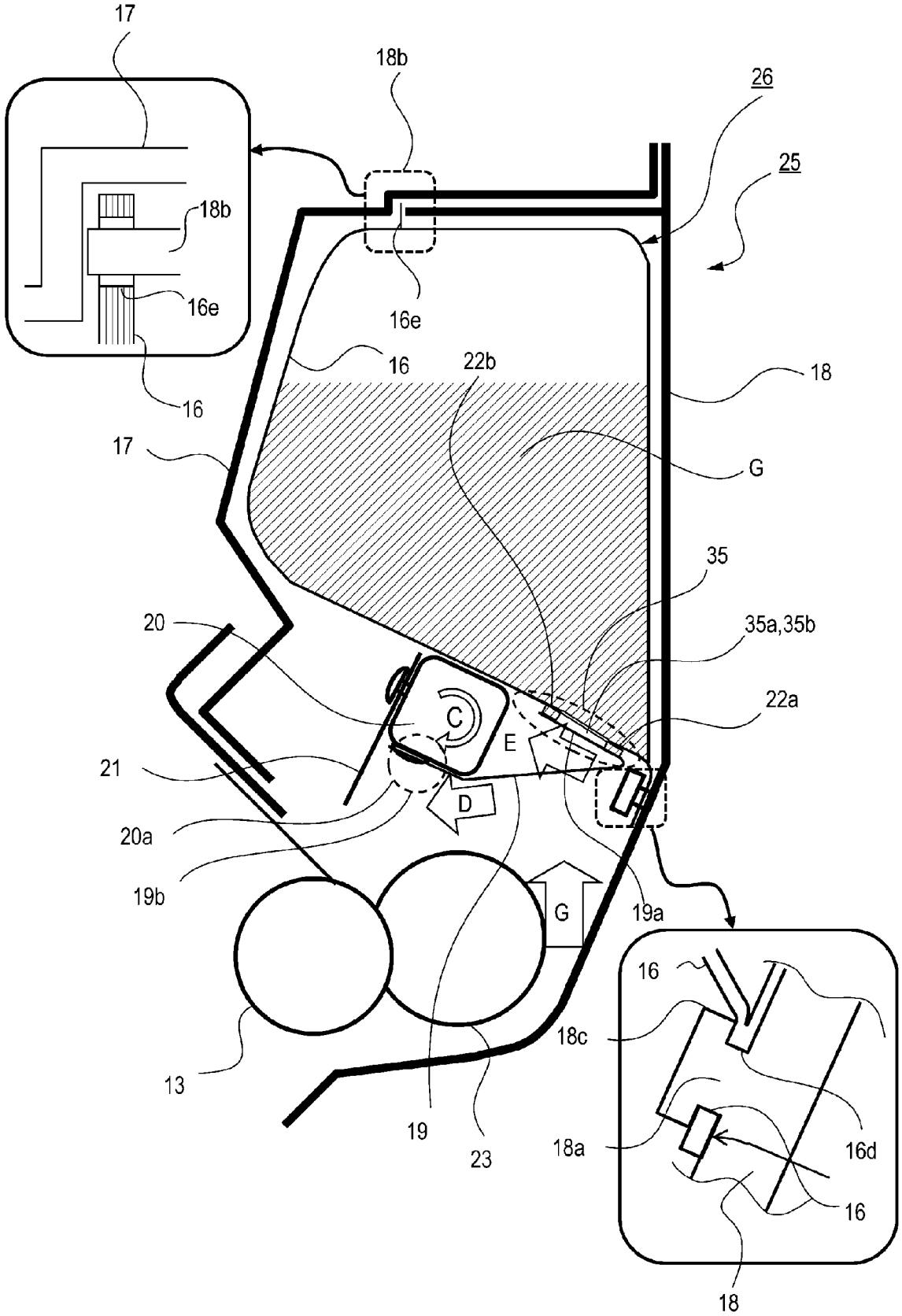
FIG. 4 is a sectional view showing an inside structure of a frame.

FIG. 3 is a perspective view showing an inside mechanism of the frames 17 and 18 in cross section. FIG. 4 is a sectional view showing a structure of the developer accommodating unit 25 and shows a state in which a sealing portion 19*a* of the sealing member 19 closes (covers) the openings 35*a*. FIG. 6 is a sectional view showing a structure of the developer accommodating unit 25 and shows a state in which the sealing portion 19*a* of the sealing member 19 opens (unseals) the openings 35*a*.

As shown in FIG. 3, at an upper portion of the flexible container 16, fixing portions 16*e* for fixing the flexible container 16 to the frames 17 and 18 are formed, and at a lower portion of the flexible container 16, fixing portions 16*d* for fixing the flexible container 16 to the frame 17 are formed. At a part of the side of the flexible container 16, a discharging portion 35 extending in a longitudinal direction of the flexible container 16 is formed. The discharging portion 35 includes the openings 35*a* for permitting the discharge of the developer and connecting portions 35*b* for connecting (defining)

the openings 35*a*. Herein, a side including the discharging portion 35 is referred to as the opening-containing side X also from the viewpoint that the side contains the openings 35*a*, and a side other than the side (opening-containing side X) is referred to as the another-side Y.

At an opposing position to the flexible container 16, the rotatable member 20 is disposed. The rotatable member 20 is a member rotatable about its shaft (axis) as a rotation center. On the rotatable member 20, a base end portion of the sealing member 19 is fixed. Specifically, the sealing member 19 includes an engaging portion 19*b*, a connecting portion 19*c* and the sealing portion 19*a*. The engaging portion 19*b* is fixed on the rotatable member 20, and the sealing portion 19*a* is fixed on the discharging portion 35. When the rotatable member 20 is rotated in an arrow C direction, the seal portion 19*a* opens the openings 35*a*. The sealing member 19 is fixed on the rotatable 20 at the engaging portion 19*b* by a retaining member (FIG. 4) and is fixed on the discharging portion 35 so as to block the openings 35*a* at its end portion.

As shown in FIG. 4, on the rotatable member 20, the urging sheet 21 is fixed. When the rotatable member 20 is rotated, the urging sheet 21 urges and urge-releases the flexible container 16 while being rotated. The urging sheet 21 is fixed on the rotatable member 20 at its base end portion by a retaining member. The fixing portions 16*e* of the flexible container 16 are fixed to fixing portions 18*b* of the frame 18. The fixing portions of the flexible container 16 are fixed to fixing portions 18*c* of the frame 18. Thus, the flexible container 16 is supported inside the frames 17 and 18.

As shown in FIG. 6, when the rotatable member 20 is rotated, the sealing portion 19*a* of the sealing member 19 is gradually separated from the openings 35*a*. At the same time, the urging sheet 21 approaches the flexible container 16 in order to urge the flexible container 16.

(Flexible Container Accommodating Developer)

Parts (*a*) to (*c*) of FIG. 30 are perspective views showing a structure of the flexible container 16. As shown in (*a*) of FIG. 30, the flexible container 16 is provided, at its one longitudinal end, with a filling opening 39 through which the developer is to be injected. Further, the flexible container 16 is provided, at its side, with the plurality of openings 35*a* arranged in a line in the longitudinal direction (although the openings 35*a* may also be arranged in a plurality of lines). To the openings 35*a* of the flexible container 16, the sealing member 19 is applied. Thus, an end portion of the sealing member 19 is applied onto the flexible container 16 so as to seal the openings 35*a*, at a base end portion of the sealing member 19, a hole as the engaging portion 19*b* to be engaged with the retaining member of the rotatable member 20. Incidentally, the developer is powder. Further, in a state shown in (*a*) of FIG. 30, the flexible container 16 is not filled with the developer and the filling opening 39 for permitting the filling of the developer is open.

As shown in (*b*) of FIG. 30, the developer is injected (charged) into the flexible container 16 from the filling opening 39 in an arrow direction, so that the inside of the flexible container 16 is filled with the developer. By flexibility of the flexible container 16, the filling opening 39 for permitting the filling of the developer is deformable correspondingly to a filling device and thus the filling of the developer is facilitated without causing scattering of the developer. For filling the developer, a known auger type filling device is used but another method (means) having a similar function may also be used.

As shown in (*c*) of FIG. 30, when the flexible container 16 is filled with the developer, the flexible container 16 is bonded at a bonding portion 39*a*. Thus, the respective openings 35*a* and the filling opening 39 of the flexible container 16 in which the developer is accommodated are sealed and therefore the accommodated developer does not leak out of the flexible container 16, so that the flexible container 16 can be treated as a single unit. The bonding of the bonding portion 39*a* of the filling opening 39 for permitting the filling of the developer is made by ultrasonic bonding in this embodiment but may also be made by other bonding methods using heat, a laser and the like. Incidentally, a position and a size of the filling opening 39 for permitting the filling of the developer may appropriately selected correspondingly to shapes and the like of the developer filling device and the (process) cartridge A.

(Effect of Incorporating Flexible Container in Frame)

By forming the flexible container 16, in which the developer is accommodated, in a bag shape, the developer can be treated as a unit. For that reason, a developer filling step can be separated from a main assembling step (manufacturing line) of the cartridge A. As a result, the developer is prevented from being scattered in the main assembling step (manufacturing line) of the cartridge A, so that maintenance such as cleaning of the manufacturing line can be reduced. By the prevention of the scattering of the developer during the assembling step, it is possible to omit a cleaning step of the cartridge A to be performed after the developer filling.

Also in the filling step of the developer in the flexible container 16, the flexible container 16 has flexibility, and thus the filling opening 39 for permitting the developer filling is also soft and therefore can be easily sealed with less scattering of the developer.

Further, the flexible container 16 in which the developer is accommodated has flexibility and therefore can be assembled while following a shape of the frame.

Further, in the filling step, the flexible container 16 has flexibility and therefore deforms its cross section to increase its volume in which the developer can be filled, so that a filling amount can be increased during the filling.

Further, the flexible container 37 before the developer filling has flexibility and thus can be made small (thin), so that a storing space during storage before the filling can be decreased compared with the frame which is a resinous structure.

(Structure of Flexible Container)

As shown in FIGS. 3 and 4, the flexible container 16 accommodating the developer therein and has a bag-like shape which is deformable, and is provided with the plurality of openings 35*a* at the discharging portion 35 for permitting the discharge of the accommodated developer.

Further, the flexible container 16 includes flexible container fixing portions (portions-to-be-fixed) 16*d* and 16*e* fixed to the (first) frame 17 and the (second) frame 18. Further, the flexible container 16 has at least one another-side Y which is another side having the stiffness lower than that of the opening-containing side X containing the openings 35*a*.

(Material and Air Permeability of Flexible Container)

Parts (*a*) to (*c*) of FIG. 29 are sectional views for illustrating the structure of the flexible container 16 and the sealing member 19. As shown in (*a*) of FIG. 29, the flexible container 16 is constituted by bonding a sheet 16*u* which includes the discharging portion 35 and does not have air permeability and a sheet 16*s* which has the air permeability and which is an air permeable portion to each other.

Here, a degree of the air permeability of the sheet 16*s* which is the air permeable portion may appropriately selected so that the developer is prevented from leaking out of the process cartridge 16 based on a balance with a size of the developer (particle size of powder) to be accommodated.

As a material for the sheet 16*s*, a nonwoven fabric or the like formed of polyethylene telephthalate (PET), polyethylene (PE), polypropylene (PP) or the like in a thickness of 0.03-0.15 mm may preferably be used. Further, even when the material for the sheet 16*s* is not the nonwoven fabric, a material having minute holes which is smaller in diameter than the powder such as the developer accommodated in the flexible container 16 may also be used.

Further, in this embodiment, as shown in FIGS. 3 and 29, the sheet 16*s* is disposed over the entire region of the flexible container 16 with respect to a longitudinal direction in the frame 18 side. As shown in (*b*) of FIG. 29, the sheet 16*s* may also constitute the entire flexible container 16.

As a material for the flexible container 16 other than the sheet 16*s*, a material having flexibility so as to improve an efficiency during the discharge of the developer described later may preferably be used. Further, the material for the air sheet 16*s* may also have flexibility.

(Effect of Flexible Container Having Air Permeability)

The reason why the air permeability is imparted to the flexible container 16 as described above is that the flexible container 16 can meet states during manufacturing, during transportation until a user uses the cartridge A, and during storage. First, the reason for the state during the manufacturing is that the flexible container 16 is made deformable and reducible in order to facilitate assembling the flexible container 16 with the frames 17 and 18. In the case where the flexible container 16 is not provided with the sheet 16*s*, the size thereof cannot be changed from that in a state in which the flexible container 16 is filled with the developer (the flexible container 16 is closed) and therefore the flexible container 16 is not readily deformed. For that reason, it takes time to assembly the flexible container 16 and the step is complicated. Therefore, when the air permeability is imparted to at least a part of the flexible container 16, the size of the flexible container 16 can be changed from that in the state in which the flexible container 16 is filled with the developer and then is closed, thus facilitating the assembling of the flexible container 16.

Next, the reason for the states during the transportation and during the storage is that the flexible container 16 can meet a change (difference) in air pressure between the inside and outside of the flexible container 16 during the transportation and during the storage of the cartridge A. The difference in air pressure between the inside and outside of the flexible container 16 is generated in the case where the flexible container 16 is in a lower air-pressure environment during the transportation or the like than during the manufacturing or in the case where the flexible container 16 is stored at a higher temperature than during the manufacturing. For that reason, by expansion of the flexible container 16, there is a possibility that parts contacting the flexible container 16 are deformed or broken. Therefore, there is a need to control the air pressure and the temperature during the transportation and during the storage, so that facilitates for that purpose are required and a cost is increased. However, problems caused due to the difference in air pressure between the inside and outside of the flexible container 16 can be solved by partly imparting the air permeability to the flexible container 16.

Further, in the case where the nonwoven fabric is provided with the discharging portion 35 and a bonding portions 22 (22*a*, 22*b* in FIG. 4) at a periphery of the discharging portion 35, there is a possibility that fibers of the nonwoven fabric fall out with peeling of the sealing member 19 during unsealing and then enter the developer to adversely affect the image. For that reason, the discharging portion 35 is provided to the sheet 16*u* different from the sheet 16*s* having the air permeability, so that the above-described falling-out of the fibers from the nonwoven fabric is prevented.

Further, a filling density can be increased by filling the developer while deaerating the flexible container bag 16.

(Structure of Discharging Portion of Flexible Container)

As shown in FIG. 10, the flexible container 16 includes the discharging portion 35. The discharging portion 35 includes the openings 35*a* and the connecting portions 35*b*. The openings 35*a* are provided at a plurality of positions of the discharging portion 35 of the flexible container 16 and are configured to permit the discharge of the inside developer. The connecting portions 35*b* connect the plurality of openings 35*a* and define an outer configuration of the flexible container 16.

Further, the discharging portion 35 is continuously surrounded by the bonding portion 22 to be unsealably bonded, so that the developer accommodated in the flexible container 16 is sealed with the sealing member 19.

(Structure of Bonding Portion of Flexible Container)

The bonding portion 22 has a rectangular shape consisting of two lines extending in a long direction (arrow F direction) and two lines extending in a short direction (arrow E direction) so as to surround the discharge portion 35 and therefore the bonding portion 22 enables the sealing of the discharge portion 35.

Here, of the two lines of the welded bonding portion 22 extending in the long direction (arrow F direction), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, a bonding portion closer to a fold-back portion 19*d* (FIG. 12) (or engaging portion 19*b*) described later is a first bonding portion 22*a*. Further, a bonding portion opposing the first bonding portion 22*a* via the opening 35*a* is a second bonding portion 22*b*. Further, a bonding portion with respect to a widthwise direction (arrow E direction) is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction (arrow E direction).

When the sealing member 19 is unsealed (peeled) from the flexible container 16 in the arrow E direction, in some cases, the peeling microscopically progresses also in the arrow F direction due to the deformation of the flexible container 16 by an unsealing force also in the first bonding portion 22*a* and the second bonding portion 22*b*. However, the unsealing direction in this embodiment does not refer to such a microscopic unsealing direction.

(Disposition of Openings of Flexible Container)

Next, disposition of the openings 35*a* will be described with reference to FIGS. 10, 11 and 30. The movement direction of the sealing member 19 for sealing the openings 35*a* and for exposing the openings 35*a* by being moved is an arrow D direction. By the movement of the sealing member 19, the exposure of the openings 35*a* progresses in the unsealing direction (arrow E direction). In the following, the movement direction of the sealing member 19 is the arrow D direction.

The plurality of openings 35*a* and the plurality of connecting portions 35*b* are alternately disposed along the arrow F direction (FIG. 10) perpendicular to the unsealing direction (arrow E direction). Further, the sealing member 19 is configured to be wound up by rotating the rotatable member 20 but the arrow F direction is the same direction as an axis (axial line) of the rotatable member 20.

The reason why the rotational axis direction of the developing roller 13 and the arrow F direction in which the plurality of openings 35*a* are arranged are and made equal is that the developer is easily supplied, during the discharge thereof, to the developing roller 13 over the entire longitudinal direction without being localized.

The plurality of openings 35*a* are shifted and disposed along the arrow F direction and therefore the discharging portion 35 is long in the arrow F direction and is short in the arrow E direction. That is, with respect to the arrow F direction, a distance from an end to another end of the plurality of openings 35*a* is longer than that with respect to the arrow E direction.

Thus, the discharging portion 35 where the plurality of openings 35*a* are shifted and disposed in the rotational axis direction (arrow F direction) perpendicular to the unsealing direction (arrow E direction) is long in the arrow F direction and is short in the arrow E direction. For that reason, the distance required for the unsealing can be made shorter than that required for the unsealing in the long direction (arrow F direction) and therefore a time required for the unsealing can also be made short.

Further, a constitution in which the sealing member 19 for covering the discharging portion 35 is wound up by the rotatable member 20 is employed. The rotational axis direction of the rotatable member 20 and the arrow F direction substantially perpendicular to the unsealing direction (arrow E direction) are made equal, so that winding distance and time of the sealing member 19 can be shortened.

(Shape and Direction of Openings of Flexible Container)

Each of the plurality of openings 35*a* in Embodiment 1 has a circular shape. When a discharging property is taken into consideration, an area of the openings 35*a* may preferably be large. Further, the connecting portions 35*b* defining the openings 35*a* may preferably be large (thick) in order to enhance the stiffness of the flexible container 16. Therefore, the area of the openings 35*a* and the area of the connecting portions 35*b* are required to achieve a balance in view of a material and a thickness of the discharging portion 35 and a force relationship with peeling strength during the unsealing described later and may be appropriately selected. The shape of each opening 35*a* may also be, in addition to the circular shape, a polygonal shape such as a rectangular shape, an elongated circular shape as shown in FIG. 18 in Embodiment 2 described later, and the like shape.

The arrangement of the openings 35*a* may only be required to be such that the openings 35*a* are shifted (spaced) with respect to the arrow F direction perpendicular to the unsealing direction (arrow E direction). Constitutions shown in (*a*) and (*b*) of FIG. 28 may be carried out but the present invention is not limited thereto. Even when the adjacent openings 35*a* overlap with each other, as shown in (*c*) of FIG. 23, as seen in the arrow F direction perpendicular to the unsealing direction (arrow E direction) or do not overlap with each other, as shown in (*d*) of FIG. 24, as seen in the arrow F direction, an effect of the connecting portions 35*b* described later is achieved.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. The state in which the openings 35*a* open downward with respect to the gravitational direction refers to that the direction of the openings 35*a* has a downward component with respect to the gravitational direction.

(Fixing Between Flexible Container and Frame)

With reference to FIGS. 3 and 4, a constitution of fixing between the flexible container 16 and the frame 17 (or 18) will be described. As shown in FIGS. 3 and 4, the flexible container 16 is fixed inside the frame 17 and the frame 18 by the fixing portions 16*d* and 16*e*.

(First Fixing Portion)

First, as a first fixing portion, the first fixing portion 16*d* of the frame 16 where a force is received when the sealing member 19 is unsealed (removed) from the flexible container 16 as described later is provided. The first fixing portion 16*d* is provided at a plurality of positions in parallel to the arrow F direction along which the plurality of openings 35*a* are arranged. Different from the arrangement at the plurality of positions, the first fixing portion 16*d* may also be a single fixing portion elongated in parallel to the arrow F direction (not shown).

The first fixing portion 16*d* is positioned in the neighborhood of the openings 35*a* of the flexible container 16.

The first fixing portion 16*d* of the flexible container 16 is fixed to a first fixing portion 18*a* of the frame 18.

The first fixing portion 16*d* is a fixing portion necessary for the time of unsealing the developer bag 16, and its action and arrangement will be described later in the description of the unsealing.

(Second fixing portion)

Further, as a second fixing portion, the second fixing portion 16*e* for preventing movement of the flexible container 16 downward or toward the developing roller 13 and the developer supplying roller 23 is provided.

The second fixing portion 16*e* is provided for the following two reasons. A first reason is that the second fixing portion 16*e* of the flexible container 16 is prevented from moving the flexible container 16 downward in the attitude during the image formation. For that reason, the second fixing portion 16*e* may preferably be disposed at an upper position in the attitude during the image formation.

Further, a second reason is that the flexible container 16 is prevented from disturbing the image in contact with the developing roller 13 and the developer supplying roller 23 during the image formation. For that reason, the second fixing portion 16*e* of the flexible container 16 may preferably be provided at a position remote from the developing roller 13 and the developer supplying roller 23. In this embodiment, the second fixing portion 16*e* of the flexible container 16 is disposed at an upper position remote from the developing roller 13 as shown in FIG. 4.

The second fixing portion 16*e* of the flexible container 16 is fixed to a second fixing portion 18*b* of the frame 18.

<Fixing Method Between Flexible Container and Frame>

(Fixing Method of First Fixing Portion)

Parts (*a*) to (*d*) of FIG. 27 are sectional views for illustrating a step for fixing the flexible container 16 to the frame 18. As a fixing method of the first fixing portion 16*d* of the flexible container 16, fixing by ultrasonic clamping such that a boss of the second frame 18 is passed through the hole of the flexible container 16 to be deformed is used. As shown in (*a*) of FIG. 27, before fixing, the first fixing portion 18*a* of the frame 18 has a cylindrical boss shape, and the first fixing portion 16*d* of the flexible container 16 has a hole which is open. An assembling step is described below.

First, as shown in (*b*) of FIG. 27, a projected portion of the first fixing portion 18*a* of the second frame 18 is passed through the hole of the first fixing portion 16*d* of the flexible container 16.

Then, as shown in (*c*) of FIG. 27, an end of the first fixing portion 18*a* of the frame 18 is fused by a ultrasonic clamping tool 91.

Then, as shown in (*d*) of FIG. 27, the end of the first fixing portion 18*a* of the frame 18 is deformed so that it is larger than the hole of the first fixing portion 16*d* of the flexible container 16, and thus the flexible container 16 is fixed to the frame 18.

(Fixing Method of Second Fixing Portion)

As shown in FIG. 4, as a fixing method of the second fixing portion 16*e* of the flexible container 16, clamping by the two frames 17 and 18 is used. Holes are made in the flexible container 16 to constitute the first fixing portion 16*e* of the flexible container 16, and projections are provided to the second frame 18 to constitute the second fixing portion 18*b* of the frame.

As assembling step is as follows. Projections of the second fixing portions 18*b* of the frame 18 are passed through the second fixing portions 16*e* of the flexible container 16, and then the flexible container 16 is clamped by the frame 17 so that the second fixing portions 16*e* (holes) of the flexible container 16 are not disengaged (dropped) from the projections to be fixed.

(Other Fixing Means)

As other fixing means, different from the above-described ultrasonic clamping, it is also possible to use fixing means using ultrasonic wave. For example, heat clamping using heat, (heat) welding or ultrasonic welding for directly welding the flexible container 16 to the frame 17 or the frame 18, bonding using a solvent or an adhesive, insertion of the flexible container 16 between the frames, hooking using the heat clamping, the ultrasonic clamping, a screw, or a combination of holes and projections (such as bosses), and the like means may also be used. Further, the flexible container 16 may also be fixed via a separate member provided between the frames 17 and 18 depending on appropriate design based on relationships in space, arrangement or the like between the developer bag 16 and the frames 17 and 18 (not shown).

<Structure of Sealing Member>

As shown in FIGS. 3 and 4, the sealing member 19 covers the discharging opening 35 of the flexible container 16 before use of the cartridge A to confine the developer in the flexible container 16. The sealing member 19 is moved, so that the openings 35*a* are exposed. The sealing member 19 is constituted by a sheet-like sealing member including a sealing portion 19*a* for covering (sealing) the discharge portion 35 of the flexible container 16, an engaging portion 19*b* to be fixed (engaged) with the rotatable member 20 described later, and a connecting portion 19*c* which connects the sealing portion 19*a* and the engaging portion 19*b*. The sheet-like sealing member is formed of a laminate material having a sealant layer which exhibits an easy-unsealing property described later, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* refers to a region where the sealing member 19 seals the plurality of openings 35*a* and connecting portions 35*b* of the flexible container 16. By the sealing portion 19*a*, the developer is prevented from being leaked from the inside of the flexible container 16 until before use of the cartridge A.

(Engaging Portion of Sealing Member)

The sealing member 19 has a free end portion in one end side thereof with respect to the unsealing direction (arrow E direction) and at the free end portion, the engaging portion 19*b* to be engaged with the rotatable member 20 for moving the sealing member 19 is provided. The engaging portion 19*b* as an end portion of the sealing member 19 for exposing the openings 35*a* is engaged with the rotatable member 20. The sealing member 19 may also be configured to be automatically subjected to the unsealing (pealing) by receiving a driving force from the image forming apparatus main assembly B. Or, the sealing member 19 may also be configured to be subjected to the unsealing (peeling) by being held and moved by the user. In this embodiment, the rotatable member 20 is a rotation shaft provided in the frame, and the sealing member 19 engaged with the rotatable member 20 is pulled, so that the flexible container 16 accommodating the developer is unsealed.

(Connecting Portion of Sealing Member)

A portion for connecting the bonding portion 22 and the engaging portion 19*b* is the connecting portion 19*c* (FIG. 3). The connecting portion 19*c* is a portion for transmitting a force so as to pull off the bonding portions 22 (22*a*, 22*b*) by receiving the force from the rotatable member 20.

(Folding-Back of Connecting Portion)

Referring to FIG. 12, a surface formed between the first bonding portion 22*a* and the second bonding portion 22*b* at the movement of the unsealing is taken as N1. A surface which is perpendicular to the surface N1 and which passes through the first bonding portion 22*a* is taken as N2.

The rotatable member 20 is disposed in the second bonding portion 22*b* side more than the surface N2 passing through the first bonding portion 22*a*. In other words, the sealing member 19, when it is seen along the surface of the sheet-like sealing member 19, includes a fold-back portion 19*d* where the sealing member 19 is folded back at the portion (connecting portion 19*c*) between the connecting portion 22 and the engaging portion 19*b* engaged with the rotatable member 20. The fold-back portion 19*d* may be provided with or not provided with a fold (crease). A folding angle Q of the sealing member 19 may preferably be 90 degrees or less. The folding angle Q is an angle Q between a surface of the bonding portion 22 of the flexible container 16 and a surface along the arrow D direction in which the sealing member 19 is pulled.

(Fixing of Sealing Member)

Further, fixing between the sealing member 19 and the rotatable member 20 is, in this embodiment, made by the ultrasonic clamping similarly as in the case of the first fixing portion 16*d*. Other than the ultrasonic clamping, the fixing may also be made by the (heat) welding, the ultrasonic welding, the bonding, the insertion between the frames, the hooking by a hole and a projection, or the like similarly as the means for fixing the first fixing portion 16*d* and the second fixing portion 16*e*.

(Portion Having Easy-Unsealing Property of Sealing Member)

A method of providing a peeling force of the bonding portion 22 with a desired value will be described. In this embodiment, in order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the process cartridge 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for heat sealed flexible packages (JIS-Z0238) is used.

A second method is a method in which as shown in FIGS. 4 and 7, the discharging portion 35 of the flexible container 16 is placed in a state in which the sealing member 19 is folded back with respect to an unsealing direction (arrow E direction). For example, in the state of FIG. 4, the rotatable member 20 is rotated in the rotational direction (arrow C direction), so that the sealing member 19 is pulled in a pulling direction (arrow D direction) by the rotatable member 20. As a result, the flexible container 16 and the sealing member 19 provide an inclined peeling positional relationship, as shown in FIG. 12, in which the angle Q between the surface of the bonding portion 22 of the flexible container 16 and the surface along the pulling direction (arrow D direction) of the sealing member 19 is 90 degrees or more. It has been conventionally known that the peeling force necessary to separate the both surfaces can be reduced by establishing the inclined peeling positional relationship. Therefore, as described above, the discharging portion 35 is placed in the state in which the sealing member 19 is folded back with respect to the unsealing direction (arrow E direction), so that the sealing member 19 of the bonding portion 22 and the flexible container 16 are placed in the inclined peeling positional relationship and thus the peeling force can be adjusted so as to be reduced.

<Structure of Unsealing Member>

The rotatable (unsealing) member 20 is used for the purpose of peeling the sealing member 19 from the flexible container 16 by applying a force to the sealing member 19 to move the sealing member 19. The rotatable member 20 includes a supporting portion (not shown) which has a shaft shape and which is rotatably supported by the second frame 18 at its ends, and includes an engaging portion 20*b* to which the engaging portion 19*b* of the sealing member 19. In this embodiment, the rotatable member 20 has a rectangular shaft shape, and the engaging portion 19*b* of the sealing member 19 is engaged with the engaging portion 20*b* at one of four surfaces of the rectangular shaft.

(Combined Use as Unsealing Member, Urging Member and Stirring Member)

The urging sheet 21 for externally acting on the flexible container 16 to discharge the developer accommodated in the flexible container 16, and the rotatable member 20 may be separate members but in this embodiment, the same part performs functions of the rotatable member 20 and the urging sheet 21.

Further, a function of stirring the developer discharged from the flexible container 16 and a function of the rotatable member 20 may be performed by separate members but in this embodiment, the rotatable member 20 also perform the stirring function of the stirring member.

(Effect of Combined Use as Unsealing Member, Urging Member and Stirring Member)

Thus, by using the same part (member) as the rotatable member 20, the urging sheet 21 and the stirring member, the number of parts is reduced, so that it becomes possible to realize cost reduction and space saving.

<Summary of Unsealing of Developer Accommodating Bag>

The unsealing of the flexible container (developer accommodating bag) 16 will be described with reference to FIGS. 7 and 8.

For unsealing the flexible container 16, the developer accommodating unit 25 includes a power application point portion 20*a* where the rotatable member 20 applies the force for pulling the sealing member 19, and includes the fixing portion 18*a* of the frame for fixing the flexible container 16 to be pulled.

The power application point portion 20*a* is a portion, closest to the bonding portion 22, of a portion where the sealing member 19 and the rotatable member 20 contact at the moment of the unsealing. In (*b*) of FIG. 7, a corner portion 20*c* of the rotatable member 20 constitutes the power application point portion 20*a*. The fixing portion 18*a* of the frame 18 includes a fixing portion 18*c* for suppressing movement of the flexible container 16 caused by the force during the unsealing. In this embodiment, from the bonding portion 22, the first fixing portion 18*a* of the frame and the first bonding portion 16*d* of the flexible container 16 are bonded to each other by the ultrasonic clamping, and as shown in (*b*) and (*c*) of FIG. 7 and (*a*) of FIG. 8, a portion, closer to the bonding portion 22, of the first fixing portion 18*a* bonded by the ultrasonic clamping constitutes the fixing portion 18*c*.

As shown in FIG. 4, the rotatable member 20 is rotated in the arrow C direction by transmission of the during force thereto by an unshown driving means provided to the apparatus main assembly B.

A state immediately before the sealing member 19 is pulled by further rotation of the rotatable member 20 to start the unsealing is shown in FIG. 5 and (*c*) of FIG. 7. With the rotation, the sealing member 19 fixed to the rotatable member 20 by the engaging portion 19*b* is pulled in the arrow D direction by the corner portion 20*c* (power application point portion 20*a*) of the rectangular rotatable member 20.

When the sealing member 19 is pulled, the flexible container 16 is pulled via the bonding portion 22. Then, a force is applied to the first fixing portion 16*d* of the flexible container 16, so that the flexible container 16 is pulled from the fixing portion 18*c* toward the power application point portion 20*b* by the fixing portion 18*c*. Then, in a cross section perpendicular to the rotation shaft of the rotatable member 20, the first bonding portion 22*a* is moved to approach a line connecting the power application point portion 20*a* and the fixing portion 18*c*. At this time, with respect to the arrow D direction, from a side close to the rotation shaft of the rotatable member 20, the portions are disposed in the order of the openings 35*a*, the first bonding portion 22*a*, the fold-back portion 19*d* and the fixing portion 18*c* ((*b*) of FIG. 7). Further, the unsealing member 19 is folded back between the first bonding portion 22*a* and the engaging portion 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Together with the corner portion 20*c*, also the power application point portion 20*a* is moved in the arrow C direction, and when the sealing member contacts a corner portion 20*d*, the power application point portion 20*a* is moved from the corner portion 20*c* to the corner portion 20*d*. Part (*b*) of FIG. 7 shows a state in which the power application point portion 20*a* is the corner portion 20*c*, and (*c*) of FIG. 7 shows a state in which the rotatable member 20 in further rotated and thus the power application point portion 20*a* is moved to the corner portion 20*d*.

As shown in FIG. 6 and (*c*) of FIG. 7, when the unsealing is advanced with further rotation of the rotatable member 20, also the fold-back portion 19*d* is moved in the arrow E direction. Then, the unsealing is further advanced, so that the openings 35*a* are exposed. A state in which the peeling of the second bonding portion 22*b* is to be started after the openings 35*a* are exposed is shown in (*a*) of FIG. 8. Also at this time, similarly as in the case of the peeling of the first bonding portion 22*a*, the sealing member 19 is pulled toward the power application point portion 20*a*, and the flexible container 16 stands firm toward a direction of the fixing portion 18*c* (an arrow H direction). Then, in a cross section perpendicular to the rotation shaft of the rotatable member 20, the second bonding portion 20*b* is moved to approach a line connecting the power application point portion 20*a* and the fixing portion 18*c*. Then, the force is applied to the portion of the bonding portion 22*b* in the arrow D direction, so that the second bonding portion 22*b* is separated. Thus, the second bonding portion 222*b* is peeled to complete the unsealing ((*b*) of FIG. 8 and FIG. 9). Then, the developer inside the flexible container 16 is discharged in an arrow I direction through the openings 35*a* of the discharging portion 35.

Thus, the sealing member 19 is wound up around the rotatable member 20 by the rotation of the rotatable member 20, so that the bonding portion 22 is unsealed. The sealing member 19 is wound up by the rotation and therefore a space required to move the rotatable member 20 may only be required to be a rotation space of the rotatable member 20, and compared with the case where the sealing member 19 is moved by movement other than the rotation, it is possible to realize space saving.

By providing the sealing member 19 with the fold-back portion 19*d*, so that the bonding portion 22 can be inclination-peeled without using shearing peeling and thus can be unsealed with reliability.

Further, the engaging portion 19*b*, to be engaged with the rotatable member 20, for unsealing the sealing member 19 in an end side of the sealing member 19 with respect to a direction substantially perpendicular to the arrow F direction in which the plurality of openings 35*a* are arranged is provided, so that the sealing member 19 can be engaged and unsealed with reliability.

Further, by providing the frame with the flexible container 16, the flexible container 16 is supported by the frame during the unsealing, so that even a soft and deformable flexible container 16 becomes unsealable with reliability.

With respect to the discharge of the developer during the unsealing, as described above, the bonding portion 22 is moved along the line connecting the power application point portion 20*a* and the fixing portion 18*c* (in the order of (*a*) of FIG. 7, (*b*) of FIG. 7, (*c*) of FIG. 7 and (*a*) of FIG. 8). By this motion, the developer at the periphery of the openings 35*a* is moved, so that agglomeration of the developer can be broken.

(Positional Relation of Fixing Portion Associated with Unsealing)

As shown in FIG. 4, in order to peel off the first bonding portion 22*b* with reliability, the following positional relation is required between the first bonding portion 22*b* and the fixing portion 18*c*. During the unsealing, with respect to the fixing portion 18*c*, the rotatable member 20 pulls the sealing member 19 in the arrow D direction. At this time, with respect to the movement direction (arrow D direction) of the sealing member 19 by the rotatable member 20, the fixing portion 18*c* is provided upstream of the openings 35*a*. For that reason, a force is applied to the fixing portion 18*c* in the arrow H direction. Therefore, when the unsealing force is applied, the sealing member 19 is pulled in the arrow H direction and the arrow D direction between the fixing portion 18*c* and the rotatable member 20 to apply a force to the first bonding portion 20*a*, thus advancing the unsealing. Thus, when the fixing portion 18*c* is not provided upstream with respect to the movement direction (arrow D direction) of the sealing member 19, the entire flexible container 16 is pulled in the direction in which the sealing member 19 is pulled, so that the force cannot be applied to the first bonding portion 22*a* and thus the first bonding portion 22*a* cannot be unsealed.

In this way, the fixing portion 18*c* is provided upstream with respect to the movement direction (arrow D direction) of the sealing member 19, so that reliable unsealing becomes possible.

(Distance Relation of Fixing Portion Associated with Unseal)

As shown in FIGS. 22 and 23, in order to peel off the first bonding portion 22*b* with reliability, the following length relationship is required between the first bonding portion 22*a* and the fixing portion 18*c*. First, a point of the first bonding portion 22*a* finally peeled off when a flat surface which passes the rotatable member 20, the openings 35*a* and the fixing portion 18*c* and which is perpendicular to the rotation shaft of the rotatable member 20 is viewed, is taken as a first point 22*d*. The first point 22*d* is an end point of the first bonding portion 22*a* close to the openings 35*a*. A distance from the fixing portion 18*c* to the first point 22*d* along the flexible container 16 is taken as M1. A distance from the first fixing portion 18*c* to the first point 22*d* along the flexible container 16 with respect to the direction including the openings 35*a* is taken as M2. The openings 35*a* provide a space in which the material for the flexible container 16 is not present but a width of the openings 35*a* is also included in the distance M2.

In this case, a relationship of M1<M2 is satisfied to permit the peeling-off of the first bonding portion 22*a*. The relationship of M1<M2 will be described specifically.

($M1<M2$)

First, in the case where M1<M2 is satisfied, as shown in FIG. 22, a force for pulling the sealing member 19 toward the first bonding portion 22*a* (in the arrow D direction) by the rotatable member 20 and a retaining force of the fixing portion (in the arrow H direction) are applied to the first bonding portion 22*a*, so that inclination peeling of the first bonding portion 22*a* can be effected. By effecting the inclination peeling, the peeling force can be set at a low level. Part (*a*) of FIG. 22 shows a state before the unsealing, and (*b*) of FIG. 22 shows a state immediately before the first bonding portion 22*a* is unsealed.

($M1>M2$)

On the other hand, in the case of M1>M2, as shown in FIG. 23, the pulling force by the rotatable member 20 is not applied to the first bonding portion 22*a* but is applied to the second bonding portion 22*b*. In this case, the force is not applied to the first bonding portion 22*a* and therefore the first bonding portion 22*a* is not peeled. In this case, the force from the rotatable member 20 (in the arrow D direction) and the retaining force of the fixing portion 18*c* (in the arrow H direction) are applied to the second bonding portion 22*b*. In this state, to the second bonding portion 22*b*, the force for pulling the sealing member 19 by the rotatable member 20 (in the arrow D direction) and the retaining force of the fixing portion 18*c* (in the arrow H direction) are applied. At the portion of the second bonding portion 22*b*, the peeling relationship is a shearing peeling relationship and therefore it is difficult to unseal the second bonding portion 22*b*. This is because the shearing peeling requires a large force thereon that of the inclination peeling.

Part (*a*) of FIG. 23 shows a state before the unsealing, and (*b*) of FIG. 23 shows a state when the force for pulling the sealing member 19 by the rotatable member 20 (in the arrow D direction) is applied to the bonding portion (the second bonding portion in this case) by the rotation of the rotatable member 20. To the second bonding portion 22*b*, the force is applied but is applied based on the shearing peeling and therefore compared with the case of the inclination peeling, a very large force is required, so that it becomes difficult to reduce the peeling force.

(Distance in Case where Projection is Present)

Definition of a manner of measuring the above-described distances M1 and M2 will be described. The distances M1 and M2 are important when the sealing member 19 is pulled during the unsealing. In the case where there is no projection (projected connecting portion) 16*t* at an intermediate position of paths of M1 and M2, the distances developed as shown in FIGS. 22 and 23 may only be required to be measured. Further, in the case where there is the projection 16*t* formed, by bonding in manufacturing, at the intermediate position of the paths of M1 and M2, even when the sealing member 19 is pulled during the unsealing, the projection 16*t* is not elongated (peeled off) and therefore the portion of the projection 16*t* is not included in the distances M1 and M2. That is, the portion, such as the projection 16*t*, which does not affect transmission of the force is not included in the distances M1 and M2.

As described above, based on the relationship of M1<M2, the first bonding portion 22*a* is unsealed earlier than the second bonding portion 22*b*. As a result, the fold-back portion 19*d* of the sealing member 19 is provided closer to the first bonding portion 22*a*. By this fold-back portion 19*d*, the peeling is not the shearing peeling but is the inclination peeling. As a result, with reliability, the sealing member 19 can be peeled off from the flexible container 16, so that it is possible to provide an unsealable developer accommodating unit 25.

(Plurality of Fixing Portions)

A relation between a plurality of fixing portions and the unsealing will be described with reference to (*a*) and (*b*) of FIG. 31, wherein (*a*) of FIG. 31 shows a state before the unsealing, and (*b*) of FIG. 31 shows a state immediately before the rotatable member 20 is rotated from the state of (*a*) of FIG. 31 to unseal the first bonding portion 22*a*. In this embodiment, the first fixing portion 18*a* and the second fixing portion 18*b* are provided. The force during the unsealing is applied to the first fixing portion 18*a* disposed at a place close to the first bonding portion 22*a*, which is first unsealed, spaced from the second bonding portion 22*b* via the openings 35*a*. For that reason, the second fixing portion 18*b* is not required to be taken into consideration in the measuring manners of the distances M1 and M2 described above. Thus, in the case there are the portion fixing portions, the unsealing is effected on the basis of the fixing portion disposed at the place close to the first bonding portion 22*a*, which is first unsealed, spaced from the second bonding portion 22*b* via the openings 35*a* to which the force during the unsealing is to be applied.

(Positional Relation of Second Bonding Portion)

With reference to FIG. 12 showing a state immediately before the first bonding portion 22*a* is unsealed, an arrangement in which the second bonding portion 22*b* can be more satisfactorily unsealed without being wound up around the rotatable member 20 will be described. First, an end portion of the first bonding portion 22*a* remote from the openings 35*a* is taken as a second point 22*e*. An end portion of the second bonding portion 22*b* remote from the openings 35*a* is taken as a third point 22*f*. A distance from the second point 22*e* to the third point 22*f* is taken as L1. A distance from the second point 22*e* to the power application point portion 20*a* is taken as L2. In this case, the distances L1 and L2 are required to satisfy the relationship of L1<L2.

This is because in the case where L1 is larger than L2, the second bonding portion 22*b* reaches the power application point portion 22*a* before the peeling of the second bonding portion 22*b* is ended, and thus the second bonding portion 22*b* is wound about the rotatable member 20. Therefore, the force cannot be applied so as to peel off the sealing member 19 from the second bonding portion 22*b*. For that reason, it becomes difficult to unseal the sealing member 19 from the flexible container 16.

As described above, the relationship between the distance L1 and L2 is made to satisfy: L1<L2, the sealing member 19 is satisfactorily unsealable without being wound about the rotatable member 20.

(Function of Connecting Portions Defining Openings)

A summary of the connecting portions 35*b*, defining the openings 35*a*, which perform a large function in the unsealing operation of the flexible container 16 will be described.

FIG. 11 is a schematic view of the discharging portion 35 when the peeling at the first bonding portion 22*a* to be first unsealed is ended to expose the openings 35*a*, and shows a state in which the peeling at the second bonding portion 22*b* is not ended. As described above, the discharging portion 35 includes the plurality of openings 35*a* shifted and disposed along the direction (arrow F direction) perpendicular to the unsealing direction (arrow E direction) in which the exposure of the openings 35*a* is advanced. For that reason, also the portion connecting portions 35*b* defining the plurality of openings 35*a* are disposed along the arrow F direction. As a result, the portion connecting portions 35*b* connect the first bonding portion 22*a* and the second bonding portion 22*b* with respect to the unsealing direction (arrow E direction) of the openings 35*a*. For that reason, at the time of the state of (*a*) of FIG. 8 in which the unsealing of the first bonding portion 22*a* is ended, the force for unsealing the second bonding portion 22*b* can be received by the first fixing portion 16*d* via the connecting portions 35*b*, so that the force for peeling off the sealing member 19 from the flexible container 16 can be transferred. That is, the forces are applied to the second bonding portion 22*b* in the arrow D direction and the arrow E direction, so that also at the second bonding portion 22*b*, the sealing member 19 is peelable.

A similar effect can be obtained also in cases other than the case where the openings 35*a* are arranged in the direction (arrow F direction) perpendicular to the unsealing direction (arrow E direction) as shown in (*b*) of FIG. 28 as described above. Even when the openings 35*a* are not completely arranged in the direction perpendicular to the unsealing direction (arrow E direction) as shown in (*c*) of FIG. 28, the connecting portions 35*b* can transmit the force, for peeling off the sealing member 19 from the flexible container 16, in an arrow P direction. Further, even when the openings 35 overlap each other with respect to the unsealing direction (arrow E direction) as shown in (*d*) of FIG. 28, the connecting portions 35*b* can transmit the force, for obliquely peeling the sealing member 19 from the flexible container 16, in an arrow P direction. That is, the plurality of openings 35*a* may only be required to be shifted and disposed with respect to the arrow F direction perpendicular to the unsealing direction (arrow E direction).

Further, as shown in (*b*) of FIG. 28, a portion including the connecting portions 35*b* provided at a periphery of the openings 35*a* may also be used as the bonding portion 22. Also in this case, by the presence of the connecting portions 35*b*, the force can be transmitted until the sealing member 19 is completely peeled off at the bonding portion 22, so that the unsealing is effected with reliability.

As for a relationship between the rotation shaft of the rotatable member 20 and the openings 35*a*, it can be said that the openings 35*a* are shifted and disposed in the direction (arrow F direction) of the rotation shaft of the rotatable member 20. As a result, the connecting portions 35*b* for connecting the first and second bonding portions 22*a* and 22*b* with respect to the direction (the arrow E direction) perpendicular to the rotation shaft of the urging member 20. The openings 35*a* may only be required to be shifted and disposed in the rotational axis direction (indicated by the arrow F) of the unsealing member. Even when the openings 35*a* overlap with each other with respect to the rotational axis direction (indicated by the arrow F) as shown in (*b*) of FIG. 28 and do not overlap with each other completely with respect to the rotational axis direction (indicated by the arrow F) as shown in (*d*) of FIG. 28, the force can be transmitted in the arrow P direction and thus the effect of the connecting portions 35*b* can be achieved.

Thus, by the presence of the connecting portions 35*b* for connecting the first and second bonding portions 22*a* and 22*b* at the discharging portion 35 of the developer flexible container 16 accommodating the developer and a flexible container 30 including the unsealing member, the unsealing force of the rotatable member 20 can be transmitted until the second bonding portion 22*b* is unsealed, so that the discharging portion 35 can be unsealed with reliability.

A relationship between the openings 35*a* and the engaging portion 19*b* of the sealing member 19 will be described (FIG. 3). The engaging portion 19*b* is provided in an end side of the sealing member 19 with respect to the direction substantially perpendicular to the direction in which the plurality of openings 35*a* are arranged.

A relationship between the openings 35*a* and the rotatable member 20 will be described (FIG. 3). The rotatable member 20 is provided in an end side of the sealing member 19 with respect to the direction substantially perpendicular to the direction in which the plurality of openings are arranged.

Also in such a constitution, it is possible to obtain the effect of transmitting the unsealing force of the rotatable member 20 by the connecting portions 35*b* until the second bonding portion 22*b* is unsealed.

(Example of Connecting Portions as Separate Member)

The connecting portions 35*b* defining the openings 35*a* may also be provided as a separate member (connecting members 16*f*) as shown in FIG. 21. In this case, a constitution in which a single long opening 16*a* elongated in the arrow F direction perpendicular to the unsealing direction (arrow E direction) and then the connecting members 16*f* as the separate member connecting both sides of the opening 16*a* along the unsealing direction (arrow E direction) are provided on the opening 16*a* is employed. At this time, the connecting members 16*f* are bonded in each of the first bonding portion 22*a* side and the second bonding portion 22*b* side of the opening 16*a* by adhesive bonding, welding or the like.

Also in the case where the flexible container 16 is provided with the connecting members 16*f*, the sealing member 19 is folded back between the bonding portion 22 and the engaging portion 18*b* as described above and is wound around the rotatable member 20, so that the flexible container 16 is unsealable. By employing such a constitution, the connecting portions 35*b* defining the openings 35*a* in the case where the plurality of openings 35*a* are provided, and the connecting members 16*f* perform the same function. That is, the single long opening 16*a* is the same as the plurality of openings 35*a* by providing the connecting members 16*f*.

Therefore, when the sealing member 19 is peeled at the second bonding portion 22*b* after the unsealing of the first bonding portion 22*a* is ended, the force (arrow D direction) during the unsealing of the second bonding portion 22*b* by the rotatable member 20 can be received by the first fixing portion 16*d* via the connecting members 16*f* with respect to the arrow H direction. Thus, the force for peeling the sealing member 19 from the flexible container 16 can be transmitted. That is, the forces are applied to the second bonding portion 22*b* in the arrow D direction and the arrow H direction, so that also the second bonding portion 22*b* is unsealable.

In this way, the single long opening 16*a* is combined with the connecting members 16*f* to form the plurality of openings 35*a*, so that it also becomes possible to increase the stiffness of only the connecting members 16*f*.

(Problem of Unsealing Property in Case of No Connecting Portion)

An example in which the present invention is not applied and thus it is difficult to unseal the flexible container 16 will be described. This is the case where there are no connecting portions 35*b* and thus it becomes difficult to unseal the developer bag 16 as shown in FIGS. 13 and 14. Parts (*a*) and (*b*) of FIG. 13 show an example in which there are no connecting portions 35*b* and a single long opening 16*a* is provided. Part (*a*) of FIG. 13 shows a state before the peeling at the second bonding portion 22*b*, and (*b*) of FIG. 13 and FIG. 15 show a state when the sealing member 19 is peeled at the second bonding portion 22*b*. Parts (*a*) and (*b*) of FIG. 8 are enlarged sectional views of the openings 35*a* and their periphery in states before and after the sealing member 19 is peeled at the second bonding portion 22*b* in this embodiment, and (*a*) to (*c*) of FIG. 14 are sectional views of the opening 16*a* and its periphery in the case where there are no connecting portions 35*b* and thus it becomes difficult to unseal the developer bag 16.

In this case, a state in which the unsealing is advanced to the second bonding portion 22*b* is shown in (*a*) of FIG. 14, and from this state, the sealing member 19 is pulled and moved in the arrow D direction by further rotation of the rotatable member 20. Then, since there are no connecting portions 35*b*, the force from the first fixing portion 16*d* cannot be transmitted to the second bonding portion 22*b* side at the central portion of the opening 16*a*. For that reason, as shown in (*b*) of FIG. 14 and (*b*) of FIG. 13, a binding force of the fixing portion 18*a* of the frame to the second bonding portion 22*b* is eliminated, so that the opening 16*a* gradually opens largely in the arrow D direction. Further, the second bonding portion 22*b* is pulled by the sealing member 19, so that the opening 16*a* is deformed as shown in (*c*) of FIG. 14. In this case, a force acting on the second bonding portion 22*b* fails to provide the inclination peeling positional relationship as shown in FIG. 8 and causes the shearing peeling (approximately 0-degree peeling) by the deformation of the opening 16*a* as shown in (*c*) of FIG. 14, so that there is a need to apply a large force for the peeling. In addition, the supporting force of the first fixing force 16*d* cannot be transmitted to the second bonding portion 22*b* and therefore the second bonding portion 22*b* is pulled by the rotatable member 20 without causing the peeling of the sealing member 19 therefrom. For that reason, the opening 16*a* in the neighborhood of a longitudinal central portion of the second bonding portion 22*b* further opens largely, so that the second bonding portion 22*b* is wound about the rotatable member 20.

Incidentally, when a developer accommodating member is a rigid structure, there is no such a deformation, so that the sealing member is unsealable as in the conventional example. However, in the case of a constitution in which the developer is accommodated in a soft deformation bag-like member and an opening which is deformed during unsealing is unsealed, as described above, when there are no connecting portions 35*b*, it is difficult to effect the unsealing.

As described above, the sealing member 19 (toner seal) is made unsealable transmitting the driving force to the rotatable member 20 of the image forming apparatus 100 and thus there is no need for the user to peel off the toner seal, so that the developer accommodating unit 25 and the cartridge A can be simply and easily replaced and used. Further, the sealing member 19 after the unsealing is fixed to the rotatable member 20, so that the unsealing can be effected without demounting a waste material from the cartridge A.

<Summary of Urging Member and Developer Discharge)

(Urging Member)

As shown in FIGS. 16 and 17, the urging sheet 21 is mounted on a surface of the rotatable member 20 which is rectangular in cross section. To the rotatable member 20, the driving force is transmitted by the unshown driving means inside the apparatus main assembly B, and when the rotatable member 20 is rotated in the arrow C direction, the urging sheet 21 is rotated together with the rotatable member 20 in the arrow C direction. The urging sheet 21 is a flexible sheet formed of a material such as PET, PPS (polyphenylene sulfide) or polycarbonate, in a thickness of about 0.05-0.1 mm, and an end thereof projects to the outside of a circumscribed circle of the rotatable member 20. In this embodiment, on different surfaces of the rotatable member 20, the sealing member 19 and the urging sheet 21 are fixed but may also be fixed on the same surface of the rotatable member 20. In the following, features will be described.

The flexible container 16 is disposed at a part of the inner wall surface (in the upper region of the frames 17 and 18). When the urging sheet 21 of the urging member 500 or the sealing member 19 urges the flexible container 16 to increase the urging force of the flexible container 16 against the frames 17 and 18, the flexible container 16 is pressed against the frames 17 and 18 to be contracted. When the urging force of the urging member 500 toward the flexible container 16 is weakened, the flexible container 16 is rebounded by the frames 17 and 18 to be expanded. Thus, the flexible container 16 becomes small by being pressed against the frames 17 and 18 and becomes large by being rebounded by the frames 17 and 18, so that the flexible container 16 is efficiently contracted and expanded to facilitate the discharge of the developer G from the openings 35*a*.

The urging member 500 changes the position of the opening-containing side X by urging the flexible container 16. This is because the developer G is discharged from a portion thereof at a periphery of the openings 35*a* and thus the change is position of the opening-containing side X most facilitates the discharge of the developer G.

The flexible container 16 is formed so that a position between the plurality of sides is curved, and the urging member 500 urges the opening-containing side X. This is because the developer G is discharged from the portion thereof at the periphery of the openings 35*a* and thus the urging of the opening-containing side X most facilitates the discharge of the developer G.

The urging member 500 is rotatable provided in the frames 17 and 18, and a distance from its rotation center to an outer edge thereof is different with respect to the circumferential direction when viewed from its cross section perpendicular to the rotation center thereof. Particularly, the cross-sectional shape of the rotatable member 20 is not a circle but may also be a polygon and this is also a point in that the distance from the rotation center to the outer edge is different with respect to the circumferential direction. Therefore, when the urging sheet 21 is rotated, the urging member 500 repeats such an operation that it pushes and pulls the flexible container 16.

The urging member 500 (particularly the urging sheet 21 or the sealing member 19) is capable of stirring the developer G, inside the frames 17 and 18, discharged from the flexible container 16 and then is capable of feeding the developer G toward the supplying roller 23 and the developing roller 13.

<Summary of Developer Discharge from Developer Accommodating Bag>

(Summary of Discharge from Before Unsealing to During Unseal)

First, the discharge of the developer from before the unsealing to the time of start of the unsealing will be described. As described above with reference to FIGS. 7 and 8, the sealing member 19 is pulled toward the power application point portion 20*a* (in the arrow D direction), and the flexible container 16 is supported by the fixing portion 18*c*. For that reason, during unsealing, three places consisting of the power application point portion 20*a*, the fixing portion 18*c* of the frame and the place of the bonding portion where the sealing member 19 is peeled and moved in a direction in which these three places are aligned in a rectilinear line in a cross section perpendicular to the rotation shaft of the rotatable member 20. Thus, the position of the openings 35*a* is changed between the time before the rotatable member 20 applies the force to the sealing member 19 to perform the unsealing operation and the time when the unsealing operation is started to unseal the first bonding portion 22*a*, so that stagnation of the developer in the neighborhood of the openings 35*a* can be prevented and thus a discharging property is good.

(Summary of Discharge after Unsealing/During Urging)

The openings 35*a* formed to open downward with respect to the vertical direction. Before image formation, a part of the sealing member 19 of the urging member 500 closes the openings 35*a*, and during the image formation, the part of the sealing member 19 opens the openings 35*a*. The openings 35*a* are formed to open downward, and therefore only by opening the openings 35*a* by the sealing member 19, the developer G is discharged from the flexible container 16 by the gravitation. Thus, when the openings 35*a* of the flexible container 16 are unsealed, the developer in the neighborhood of the openings 35*a* is readily discharged by the action of the gravitation of the developer itself and vibration of the flexible container 16, and the like.

After the unsealing, when the rotatable member 20 is further rotated, also the urging sheet 21*b* for urging the flexible container 16 fixed to the rotatable member 20 is rotated, so that the distance 21*b* is wound about the rotatable member 20 by the flexible container 16 as shown in FIG. 9. As shown in FIG. 16, the urging sheet 21*b* has elasticity and therefore is likely to be restored to an original shape, thus urging the flexible container 16 in an arrow J direction. At this time, the flexible container 16 is urged by the urging sheet 21*b* and is pressed against the second frame 18 via the toner, so that the entire flexible container 16 is deformed. The flexible container 16 is urged by the urging sheet 21*b* to be decreased in its inside volume.

The openings 35*a* formed to open downward with respect to the vertical direction. Before image formation, a part of the sealing member 19 of the urging member 500 closes the openings 35*a*, and during the image formation, the part of the sealing member 19 opens the openings 35*a*. The openings 35*a* are formed to open downward, and therefore only by opening the openings 35*a* by the sealing member 19, the developer G is discharged from the flexible container 16 by the gravitation. Thus, when the openings 35*a* of the flexible container 16 are unsealed, the developer in the neighborhood of the openings 35*a* is readily discharged by the action of the gravitation of the developer itself and vibration of the flexible container 16, and the like.

In this case, by providing the flexible container 16 with the another-side Y having the stiffness lower than that of the opening-containing side X containing the openings 35*a*, the weak another-side Y is deformed, so that it becomes possible to discharge the developer in a state in which the strong opening-containing side X maintains the shape of the openings 35*a*. In this embodiment, a magnitude of the stiffness of the sides is controlled by the thickness of the sheet. That is, the thickness of the another-side Y of the flexible container 16 is made smaller than that of the opening-containing side X of the flexible container 16. In addition, the magnitude of the stiffness of the sides can be controlled by a material, a material constitution, or the like. For example, the material for the flexible container in the present invention is assumed to be polyethylene formed in a single layer, but by employing a two-layer structure of polyethylene and polyethylene terephthalate, mechanical strength can be increased. As a method of measuring the stiffness of the sides, objects to be measured which are to be compared are cut in the same dimension and thereafter each object to be measured (test piece) is supported by a supporting table at its end portions. The test piece is deformed at its central portion in an amount corresponding to an amount of the deformation of the flexible container in a state in which no developer is accommodated in the flexible container, and a force for the deformation is measured. As a result, it is possible to discriminate the magnitude of the stiffness of the sides. Thus, by the decrease in inside volume of and the change in entire shape of the flexible container 16, the developer inside the flexible container 16 is stirred and as a result, the developer is readily discharged from the openings 35*a*. At this time, the flexible container 16 is closed except for the openings 35*a* and thus there is no escape route except for the openings 35*a*, and therefore the discharging property from the openings 35*a* is high. By the discharging action as described above, the developer is readily discharged in the arrow I direction.

In the case, when the flexible container 16 is contacted to and pressed against the second frame 18 at least at a part thereof, the flexible container 16 is deformable.

By aligning the rotational axis direction of the developing roller 13 and the arrangement direction (arrow F direction) of the plurality of openings 35*a*, the developer can be easily supplied over the entire longitudinal direction of the developing roller 13 during the discharge without being localized.

When the developer accommodating unit 25 is mounted in the image forming apparatus 100, by providing the openings 35*a* so as to open toward the direction of gravitation, the developer discharging property can be improved.

Further, the urging sheet 21 provided in the frames 17 and 18 urges the flexible container 16 so as to be pressed against the frame 18, so that the developer discharging property can be improved.

(Summary of Discharge/Developer Bag Shape Restoration)

As shown in FIG. 17, the rotatable member 20 is further rotated, so that the urging sheet 21*b* is separated from the flexible container 16. At this time, the flexible container 16 has flexibility and therefore is likely to be restored to the state before the urging by the weight of the developer (arrow K direction). Then, also the sealing member 19 is rotated and urges the flexible container 16 toward the frame 18 as shown in FIG. 16, so that the flexible container 16 is deformed to move the developer at a position other than the neighborhood of the openings 35*a* and thus the developer is discharged from the openings 35*a*.

(Summary of Discharge/Repetition of Urging and Restoration)

In the case where the developer immediately after the unsealing is accommodated in the flexible container 16 in a large amount, a penetration depth (entering amount) of the urging sheet 21, the sealing member 19 and the rotatable member 20 with respect to the flexible container 16 is repetitively changed, so that the flexible container 16 is deformed so as to be pressed against the frame 18. Contraction of the flexible container 16 by the urging with the urging member 21 and restoration of the shape of the flexible container 16 by the weight of the developer inside the flexible container 16 and by the flexibility of the flexible container 16 are repeated. Further, by the above-described action, the flexible container 16 itself is moved and therefore the flexible container 16 is vibrated, so that the developer inside the flexible container 16 is discharged from the openings 35*a* also by the vibration of the flexible container 16. The urging sheet 21 is rotated and therefore is capable of repetitively urging the flexible container 16.

(Example in which Flexible Container is Applied to Frame)

A portion 27 where the developer bag 16 is urged against the frame 18 is as shown in FIG. 25, even in the case where a bonding portion 28 such as an adhesive or a double-side tape is provided and bonds the flexible container 16 to the second frame 18, the urging sheet 21*b* can urge the flexible container 16 to discharge the developer.

(Case where Amount of Developer is Small)

The case where the amount of the developer inside the flexible container 16 is decreased by image formation will be described with reference to (*a*) and (*b*) of FIG. 32. Immediately after the unsealing, as shown in (*a*) of FIG. 32, the shape of the flexible container 16 follows a shape, defined by the urging sheet 21, in such a manner that the flexible container 16 always contacts the urging sheet 21 by the weight of the accommodated developer, so that a size (inside volume) is periodically changed. However, when the amount of the accommodated developer becomes small, as shown in (*b*) of FIG. 32, the weight of the developer becomes light, so that the flexible container 16 does not follow the urging sheet 21 and thus repeats periodical separation from and contact with the urging sheet 21. For that reason, the size (inside volume) of the flexible container 16 is not so changed. For that reason, a developer discharging effect by the change in inside volume of the flexible container 16 is decreased but by the periodical contact between the flexible container 16 and the urging sheet 21, the flexible container 16 is vibrated and thus the developer can be discharged. Further, the opening-containing side X containing the openings is provided with the stiffness, so that the vibration can be more transmitted, so that the developer discharging property can be ensured.

(Combined Use as Urging Sheet and Sealing Member)

A single part may be used as the urging sheet 21 and the sealing member 19 to have functions of these members. After the unsealing, the bonding portion 22 is separated from the flexible container 16 and therefore an end of the sealing member 19 in the bonding portion 22 side is a free end. For this reason, the sealing member 19 can have the function of the urging sheet 21. Thus, the rotatable member 20 can have the function of the rotatable member 20 for the urging sheet 21, and the sealing member 19 can have the function of the urging sheet 21. As a result, it is possible to reduce the number of parts and thus cost reduction can be realized.

As described above, the developer inside the flexible container 16 can be satisfactorily discharged without providing another discharging part such as a developer discharging roller at the openings 35*a* as a developer discharging port, so that agglomeration and bridge of the developer in the neighborhood of the openings 35*a* can be prevented. As a result, even in the case where the developer in the flexible container 16 is agglomerated by tapping during transportation, storage or the like, the agglomerated developer is broken by the movement of the entire flexible container 16 and the periphery of the openings 35*a* as described above, so that it is possible to prevent a state in which it is difficult to discharge the developer.

(Example of Single Part for Urging Member)

The urging sheet 21 is not constituted by separate parts consisting of the rotatable member 20 and the urging sheet 21 but may also be constituted by a single part, as shown in (*a*) of FIG. 26, prepared by providing the urging sheet 21 integrally with a projection 21*c* functioning as the urging sheet 21. Also in this case, similarly, the developer can be discharged. In the case where the urging sheet 21 is constituted by only the rotatable member 20, when the urging sheet 21 is viewed in its cross section perpendicular to its rotation center, the cross section of the rotatable member 20 may have a polygonal shape ((*b*) of FIG. 26) or a cam shape ((*c*) of FIG. 26). Also, in this case, the flexible container can be pressed against a frame 29 to be deformed.

This is because when the urging sheet 21 is disposed so as to contact at least the flexible container 16, a distance from the rotation center of the urging sheet 21 to the outer end of the urging member is changed and therefore the penetration depth of the urging sheet 21 with respect to the flexible container 16 is also changed. That is, so long as the shaft portion (urging member) is not a shaft portion having a circular cross section including the rotation shaft as its center, the flexible container 16 can be deformed by the rotation of the urging sheet 21. As shown in FIG. 20, a dimension of the projection 21*c* from the center of the urging sheet 21 to a remote outer end of the urging sheet 21 and a dimension 21*d* close to an outer end of the shaft portion are different from each other and therefore the penetration depth of the urging sheet 21 with respect to the flexible container 16 is also changed.

Part (*b*) of FIG. 5 is a sectional view of an urging sheet 21 having a cross-shape in cross section, and (*a*) of FIG. 5 is a cross-sectional illustration of the developer accommodating unit 25 including the cross-shaped urging sheet 21. As shown in FIG. 5, in the case where four projections 21*e* each having the same distance from the center of the urging member 21 to an associated outer end are provided, outer configurations (21*c*) of the four projections 21*e* are the same. However, the urging member 21 includes a portion, other than the projections 21*e*, having an outer end (dimension 21*d*) close to the center and therefore the penetration depth with respect to the flexible container 16 can be changed. That is, the urging sheet 21 can be constituted as a rotatable member including portions different in distance from its rotation center to its outer end in the cross section perpendicular to the rotation center of the urging sheet 21.

Thus, the flexible container 16 is unsealed by the urging sheet 21 (in the arrow J direction) to be pressed against the frame 29, thus being deformed to decrease its inside volume, so that the inside developer is pushed out to be discharged from the openings 35*a* (arrow I direction).

In an attitude during the image formation, the rotatable member 20 of the urging sheet 21 is positioned under the developer bag 16 in contact with the developer bag 16 with respect to the direction of gravitation. The cross-sectional shape of the rotatable member 20 of the urging sheet 21 is rectangular not is not circular and therefore by the rotation of the rotatable member 20, the penetration depth of the rotatable member 20 with respect to the flexible container 16 is periodically changed as described above. Also by the change in penetration depth of the rotatable member 20 with respect to the flexible container 16, the flexible container 16 can be changed in volume and can be vibrated, so that the developer discharging property can be improved.

[Embodiment 2]

(Vacuum Molding)

Parts (*a*) to (*c*) of FIG. 18 are schematic views for illustrating a structure of the developer accommodating member 34 as the "flexible container" in this embodiment. In place of the flexible container 16 in Embodiment 1, the developer accommodating member 34 is used in this embodiment. The developer accommodating member 34 used is prepared by molding a sheet-like material by vacuum molding, air-pressure molding and press molding. The cartridge A includes the developer accommodating member 34 and includes, similarly as in Embodiment 1, the sealing member 19, the rotatable member 20, the frame 17 and the frame 18.

In the following description, members having the same functions as those in Embodiment 1 are represented by the same reference numerals and will be appropriately omitted from description. Further, the assembling of the developer accommodating member 34 as the flexible container with the cartridge A, and the mounting and demounting of the cartridge A with respect to the apparatus main assembly B are the same as those in Embodiment 1 and therefore description of the cartridge and the image forming apparatus will be omitted.

(Structure of Flexible Container)

As shown in FIG. 18 and (*c*) of FIG. 29, the developer accommodating member 34 is constituted by a molded portion 34*a* which is a flexible container formed by the vacuum molding, the air-pressure molding and the press molding and constituted by a sheet-like air permeable portion 34*b*. The molded portion 34*a* and the air permeable portion 34*b* are bonded by (heat) welding, laser welding, adhesive bonding, adhesive tape bonding or the like. The reason why an air permeability is imparted to the developer accommodating member 34 is that the developer accommodating member 34 meets states during manufacturing, during transportation and during storage similarly as in Embodiment 1.

As the material for the molded portion 34*a*, materials such as ABS, PMMA, PC, PP, PE, HIPS, PET, PVC and composite multi-layer materials of these materials may preferably be used. The thickness of the molded portion 34*a* in the sheet shape before the molding may preferably be about 0.1-1 mm. The material and thickness of the molded portion 34*a* may appropriately selected depending on cost, product specification, manufacturing condition, and the like.

The molded portion 34*a* is formed in a hot-like shape (trapezoidal configuration) and includes an upper bottom portion 34*e*, a perpendicular side 34*g* and an inclined portion 34*f* (tapered portion). From the perpendicular side 34*g*, an outer peripheral side 34*c*1 is extended upward vertically, and from the inclined side 34*f*, an outer peripheral side 34*c*2 is extended downward vertically. The outer peripheral sides 34*c* and 34*c*2 are bonded to the air permeable portion 34*b*. The developer accommodating member 34 accommodates the developer therein. Further, at the outer peripheral side 34*c*2, a fixing portion 16*d* to be fixed to the frame 18 is formed. The shape of the molded portion 34*a* follows the inside shape of the frames 17 and 18 (FIG. 19).

The developer accommodating member 34, the sealing member 19 for closing and unsealing the openings 34*a* of the discharging portion 35 is mounted. The sealing member 19 is mounted on one side of the rotatable member 20.

The discharging portion 35 is provided at the molded portion 34*a*. Also a constitution of this discharging portion 35 is the same as that in Embodiment 1, and a plurality of openings 35*a* and a plurality connecting portions 35*b* for defining the plurality openings 35*a* are provided with respect to the arrow F direction substantially perpendicular to the unsealing direction (arrow E direction) in which the unsealing of the developer accommodating member 34 is advanced. That is, the plurality of openings 35*a* are shifted and disposed with respect to the arrow F direction perpendicular to the unsealing direction (arrow E direction). Further, the plurality of openings 35*a* are shifted and disposed with respect to the direction of the rotation shaft of the rotatable member 20. Further, the engaging portion 19*b* is provided in an end side of the sealing member 19 with respect to the direction substantially perpendicular to the direction in which the plurality of openings 35*a* are arranged. Further, the rotatable member 20. Further, the rotatable member 20 is provided in the end side of the sealing member 19 with respect to the direction substantially perpendicular to the direction in which the plurality of openings 35*a* are arranged. The fixing portion includes a fixing portion 16*d*, necessary for the unsealing, corresponding to the first fixing portion 16*d* in Embodiment 1. When the shape of the developer accommodating member 34 itself is intended to be maintained by the molded portion 34*a*, the developer accommodating member 34 has the shape following the frame and therefore the developer accommodating member 34 is supported by the frame as a whole, so that the developer accommodating member 34 is not readily moved toward the supplying roller 23 and the developing roller 13. Further, in the case where the inclined side 34*f*, of the flexible container 16, which is the "opening-containing side" containing the openings 35*a* is provided in a developing roller 13 side, the inclined side 34*f* containing the openings 35*a* is not readily deformed. For that reason, the developer accommodating member 34 is further not readily moved toward the supplying roller 23 and the developing roller 13.

As a means for fixing the fixing portion, it is possible to use the (heat) welding, the ultrasonic welding, the adhesive bonding, the insertion between the frames, the heat clamping, the ultrasonic clamping, the hooking using the hole and the projection, and the like.

The constitutions of the sealing member 19 and the rotatable member 20 are the same as those in Embodiment 1.

<Summary of Unsealing of Developer Accommodating Bag>

The unsealing of the flexible container (developer accommodating bag) will be described. The fixing portion and the position thereof are the substantially same as those in First Embodiment 1, and also the force relationship is the same as that in Embodiment 1. Therefore, also the unsealing step is the same as that in First Embodiment (FIGS. 7 and 8).

In Embodiment 2, the openings 35*a* are disposed at the molded portion 34*a* but also the molded portion 34*a* is flexible similarly as in Embodiment 1, so that also the force relationship is the same as that in Embodiment 1. Therefore, also in Embodiment 2, the portion connecting portions 35*b* connects the first bonding portion 22*a* and the second bonding portion 22*b* with respect to the arrow E direction in which the unsealing is advanced. For that reason, when the unsealing of the first bonding portion 22*a* is ended and the second bonding portion 22*b* is unsealed, a force for peeling the sealing member 19 from the developer accommodating member 34 can be transmitted. For that reason, the unsealing also at the bonding portion 22*b* becomes possible.

Also the developer discharging port after the unsealing is the same as that in Embodiment 1. When the sealing member 19 is unsealed from the above-described developer accommodating member 34, first, the openings 35*a* are disposed at the lower portion of the developer accommodating member 34, and therefore the position of the openings 35*a* during the unsealing is moved at the same time when the gravitation acts on the openings 35*a*, so that the developer is discharged. Further, by the vibration or the like of the developer accommodating member 34, the developer in the neighborhood of the openings 35*a* is discharged.

Further, by providing the stiffness to the inclined side 34*f* containing the openings 35*a*, the vibration can be more transmitted to the openings 35*a*, so that it becomes possible to ensure the developer discharging property. The rotatable member 20 also functions as the urging sheet 21. Further, the urging sheet 21 has a rectangular shape in the cross section perpendicular to the rotational axis direction of the urging sheet 21, and the discharge of the developer is accelerated by the rotation of the urging sheet 21 as described in Embodiment 1. The urging sheet 21 contacts the same side as the side where the openings 35*a* of the developer accommodating member 34 are provided. The developer accommodating member 34 is constituted by a plurality of sides including the side where the openings 35*a* of the developer accommodating member 34 are provided, and by another side connected to the side via a bent portion 16*h*.

(Effect of Vacuum Molding)

By forming a part of the developer accommodating member 34 through the vacuum molding, in addition to the effects in Embodiment 1, the following effects are obtained.

As a first effect, the developer accommodating member 34 can be shaped so as to follow the inside shape of the frame. For that reason, in the bag form as described in Embodiment 1, it is difficult to dispose the bag until corner portions of the frame, so that a space (spacing) is formed between the flexible container and the frame 17 and thus fails to constitute an effective developer accommodating space.

As a second effect, the developer accommodating member 34 can be shaped so as to follow the shape of the frame and therefore can be easily assembled with the frame. This is because there is no need to push the developer accommodating member into the frame during the assembling so that its shape follows the shape of the frame.

As a third effect, the developer accommodating member 34 is not readily moved toward the developer supplying roller 23 and the developing roller 13. This is because the developer accommodating member 34 is supported by the frame as a whole since the shape of the developer accommodating member 34 itself is maintained as described above by the vacuum molding and follows the shape of the frame. For that reason, the second fixing portion for preventing the movement of the developer bag toward the developer supplying roller 23 and the developing roller 13 as described in Embodiment 1 can be omitted.

As a fourth effect, control of the thickness of each of the molded sides depending on molding shape and condition becomes easy. As a result, it also becomes possible to control the stiffness of each side such that the side having the stiffness lower than that of the side containing the openings 35*a* is provided in the present invention.

Part (*b*) of FIG. 18 shows a state in which a plate material 934 which is an original material of the developer accommodating member 34 is vacuum-molded in a metal mold 200. In this case, the plate material 934 is satisfactorily extended at a perpendicular side 200*g* of the metal mold 200 but is not extended at an inclined side 200*f* compared with the case of the perpendicular side 200*g*. For this reason, the developer accommodating member 34 is higher in stiffness at the inclined side 34*f* than at the perpendicular side 34*g*. An upper bottom portion 200*e* of the metal mold 200 is remotest from an opening of the metal mold 200 and correspondingly the upper bottom portion 34*e* is extended more than the inclined side 34*f*, so that the upper bottom portion 34*e* is lower in stiffness than the inclined side 34*f*. Thus, the developer accommodating member 34 is formed by the vacuum molding at a part of the plurality of sides (although may also be formed by the vacuum molding at all of the sides), so that the inclined side 34*f* is smaller in degree of elongation of the material by the vacuum molding than the perpendicular side 34*g*.

Part (*c*) of FIG. 18 shows another example of the developer accommodating member formed by the vacuum molding. A developer accommodating member 534 includes an inclined side 534*k* constituting a tapered portion (angle θ2) gentler than the inclined side 34*f* (angle θ1). In this case, in addition to the perpendicular side 34*g* having the lower stiffness than the inclined side 34*f*, the inclined side 534*k* having the higher stiffness than the inclined side 34*f* is formed.

FIG. 19 is a sectional view showing a structure in which the developer accommodating member 34 is mounted inside the frames 17 and 18. The urging sheet 21 shown in FIG. 19 urges the inclined side 34*f* while being rotated. The developer accommodating member 34 is constituted by the plurality of sides by the vacuum molding. Therefore, a bent portion 35*d* is present between the sides of the plurality of sides. The sides of the developer accommodating member 34 is defined by bent portions 35*d*.

A difference in effect between the case where the urging sheet 21 urges the inclined side 34*f* as the "opening-containing side" including the openings 35*a* and the case where the urging sheet 21 urges the upper bottom portion 34*e* as the "another-side" which does not include the openings 35*a* will be described.

The upper bottom portion 34*e* is connected to the inclined side 34*f* including the opening 35*a* by the bent portion 35*d*. In the case where the upper bottom portion 34*e* is urged by the urging sheet 21, a force received by the urging sheet 21 reaches the inclined side 34*f* via the bent portion 35*d*. The urging force of the urging sheet 21 is largely attenuated at the bent portion 35*d* before it reaches the inclined side 34*f*. For that reason, also a force for moving the openings 35*a* becomes small compared with the case where the inclined side 34*f* including the openings 35*a* is urged directly. For that reason, the action of discharging the developer by moving the openings 35*a* becomes small. Therefore, when the urging member 21 urges the opening-containing side including the openings 35*a*, the urging member 21 can efficiently improve the discharging property of the inside developer and can prevent stagnation of the developer.

Thus, by the rotation of the urging member 21 of which function is performed by the rotatable member 20, the developer accommodating member 34 is urged so as to be pressed against the frame 18, so that the developer accommodating member 34 is deformed to change the position of the openings 35 and thus the inside developer is discharged. Further, there are the plurality of openings 35*a* and therefore the developer is readily discharged more than the case of a single opening. Further, the openings 35*a* are disposed downward with respect to the direction of gravitation in the attitude during the image formation and therefore the developer is easily discharged.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 260270/2011 filed Nov. 29, 2011, which is hereby incorporated by reference.

What is claimed is:

1. A developer accommodating unit comprising:

a flexible container for accommodating developer, said flexible container provided with an opening for permitting discharge of the developer;

a frame for (i) accommodating said flexible container and (ii) accommodating the developer discharged from said flexible container; and an urging member for urging and contracting an urged part of said flexible container, wherein said flexible container has a plurality of parts including an opening-containing part and another part having stiffness lower than that of said opening-containing part, wherein said urged part is said opening-containing part, and wherein said urging member is capable of stirring developer, inside said frame, discharged from said flexible container.

2. A developer accommodating unit according to claim 1, wherein a thickness of said another part of said flexible container is smaller than that of said opening-containing part of said flexible container.

3. A developer accommodating unit according to claim 1, wherein said urging member changes a position of said opening-containing part of said flexible container by urging said flexible container.

4. A developer accommodating unit according to claim 1, wherein said flexible container is provided with a plurality of openings.

5. A developer accommodating unit according to claim 1, wherein said opening is open downward with respect to a vertical direction, and wherein a part of said urging member closes said opening before image formation and opens said opening during image formation.

6. A developer accommodating unit according to claim 1, wherein said urging member is rotatably provided inside said frame, and wherein a first distance from a rotation center of said urging member to an outer edge of said urging member with respect to a circumferential direction when viewed in cross section perpendicular to the rotation center of said urging member is different from a second distance from the rotation center of said urging member to the outer edge of said urging member with respect to the circumferential direction when viewed in the cross section perpendicular to the rotation center of said urging member.

7. A developer accommodating unit according to claim 1, wherein said urging member includes (i) an urging sheet for urging said flexible container, (ii) a sealing member for sealing said opening and for urging, after said opening is unsealed by rotation of said urging member, said flexible container, and (iii) a rotatable member on which said urging sheet and said sealing member are fixed.

8. A process cartridge detachably mountable to a main assembly of an image forming apparatus comprising:

an electrophotographic photosensitive drum; and a developer accommodating unit according to claim 1, said developer accommodating unit being integrally assembled with said electrophotographic photosensitive drum.

9. An electrophotographic image forming apparatus comprising:

a main assembly; and a process cartridge according to claim 8, said process cartridge being integrally assembled with said main assembly.

10. An image forming apparatus according to claim 9, further comprising a controller for controlling drive of said urging member, wherein said controller rotates said urging member to repetitively urge said flexible container.

11. A developer accommodating unit according to claim 1, wherein a surface of said flexible container is provided with a plurality of openings.

12. A developer accommodating unit according to claim 1, wherein said urging member is provided inside said frame.

13. A developer accommodating unit according to claim 1, wherein said opening-containing part and said another part are connected by a bent portion.

14. A developing apparatus comprising:

a developer bearing member; and a developer accommodating unit according to claim 1.

15. A developer accommodating unit according to claim 1, wherein said opening-containing part faces said urging member.

16. A developer accommodating unit comprising:

a flexible container for accommodating developer, said flexible container provided with an opening for permitting discharge of the developer; and an urging member for urging and contacting an urged part of said flexible container, wherein said flexible container has a plurality of parts including an opening-containing part and another part having stiffness lower than that of said opening-containing part, wherein said urged part is said opening-containing part, and wherein said urging member is capable of stirring developer discharged from said flexible container.

17. A developer accommodating unit according to claim 16, wherein a thickness of said another part of said flexible container is smaller than that of said opening-containing part of said flexible container.

18. A developer accommodating unit according to claim 16, wherein said urging member changes a position of said opening-containing part of said flexible container by urging said flexible container.

19. A developer accommodating unit according to claim 16, wherein said flexible container is provided with a plurality of openings.

20. A developer accommodating unit according to claim 16, wherein said opening is open downward with respect to a vertical direction, and wherein a part of said urging member closes said opening before image formation and opens said opening during image formation.

21. A developer accommodating unit according to claim 16, wherein said urging member includes (i) an urging sheet for urging said flexible container, (ii) a sealing member for sealing said opening and for urging, after said opening is unsealed by rotation of said urging member, said flexible container, and (iii) a rotatable member on which said urging sheet and said sealing member are fixed.

22. A developer accommodating unit according to claim 16, wherein said opening-containing part and said another part are connected by a bent portion.

* * * * *